US009593636B2

(12) United States Patent
Hotani

(10) Patent No.: US 9,593,636 B2
(45) Date of Patent: Mar. 14, 2017

(54) THROTTLE LEARNING CONTROL APPARATUS

(71) Applicant: MITSUBISHI ELECTRIC CORPORATION, Chiyoda-ku, Tokyo (JP)

(72) Inventor: Hiroyuki Hotani, Hyogo (JP)

(73) Assignee: Mitsubishi Electric Corporation, Tokyo (JP)

( * ) Notice: Subject to any disclaimer, the term of this patent is extended or adjusted under 35 U.S.C. 154(b) by 378 days.

(21) Appl. No.: 14/189,639

(22) Filed: Feb. 25, 2014

(65) Prior Publication Data

US 2015/0088401 A1 Mar. 26, 2015

(30) Foreign Application Priority Data

Sep. 26, 2013 (JP) ..... 2013-199494

(51) Int. Cl.
*F02D 41/00* (2006.01)
*F02D 41/14* (2006.01)
(Continued)

(52) U.S. Cl.
CPC ..... *F02D 41/1497* (2013.01); *F02D 11/106* (2013.01); *F02D 11/107* (2013.01);
(Continued)

(58) Field of Classification Search
CPC ..... F02D 41/1497; F02D 41/2464; F02D 41/2441; F02D 41/042; F02D 41/2438;
(Continued)

(56) References Cited

U.S. PATENT DOCUMENTS 5,463,298 A * 10/1995 Kamio ..... F02D 11/106 192/103 R
5,578,749 A * 11/1996 Mogaki ..... F02D 41/28 123/478
(Continued)

FOREIGN PATENT DOCUMENTS

JP 2005-155351 A 6/2005
JP 2006-46103 A 2/2006

*Primary Examiner* — Hieu T Vo
*Assistant Examiner* — Sherman Manley
(74) *Attorney, Agent, or Firm* — Sughrue Mion, PLLC; Richard C. Turner

(57) ABSTRACT

There is obtained a throttle learning control apparatus that raises the reliability of throttle fully closed and opened learning even when a self-shutoff delay abnormality occurs and can suppress various defects that occur when a throttle fully closed learning value or a throttle fully opened learning value is not updated. After a self-shutoff delay abnormality occurs, an electronic control unit implements fully closed learning 1 and fully opened learning 1 while the engine is operated in a non-engine-stall period and implements fully closed learning 2 and fully opened learning 2 for compensating the fully closed learning 1 and fully opened learning 1. Fully closed learning is completed when the fully closed learning 1 or the fully closed learning 2 has once been implemented; similarly, fully opened learning is completed when the fully opened learning 1 or the fully opened learning 2 has once been implemented.

3 Claims, 19 Drawing Sheets

(51) Int. Cl.

| | |
|---|---|
| ***F02D 11/10*** | (2006.01) |
| *F02D 41/04* | (2006.01) |
| *F02D 41/24* | (2006.01) |
| *F02N 11/08* | (2006.01) |

(52) U.S. Cl.
CPC ..... *F02D 41/2441* (2013.01); *F02D 41/2464* (2013.01); *F02D 41/042* (2013.01); *F02D 41/2438* (2013.01); *F02D 2250/16* (2013.01); *F02N 11/0814* (2013.01)

(58) Field of Classification Search
CPC .. F02D 11/106; F02D 11/107; F02D 11/0814; F02D 2250/16
See application file for complete search history.

(56) References Cited

U.S. PATENT DOCUMENTS

| | | | | | |
|---|---|---|---|---|---|
| 5,964,202 | A * | 10/1999 | Takagi | F02D 31/003 | 123/339.1 |
| 6,067,960 | A * | 5/2000 | Watanabe | F02D 11/10 | 123/399 |
| 8,234,053 | B2 * | 7/2012 | Takayanagi | F02D 41/221 | 123/480 |
| 2003/0075146 | A1 * | 4/2003 | Niki | F02D 11/107 | 123/396 |
| 2005/0153816 | A1 * | 7/2005 | Yoda | F02D 9/1095 | 477/111 |
| 2009/0265076 | A1 * | 10/2009 | Hirose | F02D 11/106 | 701/103 |

* cited by examiner

THROTTLE LEARNING CONTROL APPARATUS

BACKGROUND OF THE INVENTION

Field of the Invention

The present invention relates to an apparatus that performs fully closed position learning control and fully opened position learning control of an electronically-controlled throttle mounted in an automobile.

Description of the Related Art

Automobiles equipped with an electronically-controlled throttle (hereinafter, also referred to as a throttle) have become widespread. It is known that throttle control is implemented through PID control based on the difference between a desired throttle opening degree and a throttle opening degree detection value. In other words, while monitoring the throttle opening degree sensor detection value, a throttle control apparatus supplies a driving current having a suitable direction and magnitude to a throttle driving motor in a direction in which the difference from the desired throttle opening degree is decreased so that the throttle opening degree detection value coincides with the desired throttle opening degree.

Several kinds of methods are known in which for the purpose of ensuring a throttle opening degree detection value, the mechanical throttle fully closed position is utilized as a reference position and a throttle control apparatus learns (hereinafter, this learning is referred to as fully closed learning and the stored value is referred to as a fully closed learning value) a throttle opening degree sensor detection value at the throttle fully closed position.

Similarly, several kinds of methods are known in which a throttle control apparatus learns (hereinafter, this learning is referred to as fully opened learning and the stored value is referred to as a fully opened learning value) a throttle opening degree sensor detection value at the mechanical throttle fully opened position.

Meanwhile, a method is known in which the fully closed learning and the fully opened learning are implemented during a self-shutoff delay period that is set immediately after the ignition key switch of an automobile has been turned off (for example, refer to Patent Document 1).

In addition, a technology is also known in which in an automobile having an idling stop function, the fully closed learning is implemented during an idling stop period (for example, refer to Patent Document 2).

PATENT DOCUMENT

[Patent Document 1] Japanese Patent Application Laid-Open No. 2005-155351

[Patent Document 2] Japanese Patent Application Laid-Open No. 2006-046103

The technology disclosed in Patent Document 1 has a problem that when an abnormality occurs in the self-shutoff delay, the power supply to the throttle control apparatus may be cut off immediately after the ignition key switch is turned off and hence the fully closed learning and the fully opened learning are not implemented.

The technology disclosed in Patent Document 2, which can solve the foregoing problem, has three problems stated below.

It is the first problem that in engine operation after an abnormality has occurred in the self-shutoff delay, the fully closed learning value is not updated when the idling stop never takes place.

It is the second problem that when an idling stop period that is shorter than a necessary time for updating the fully closed learning value occurs recurrently, the fully closed learning value cannot be updated.

It is the third problem that because the fully closed learning is implemented each time the idling stop occurs, the throttle fully closed driving for learning causes the power consumption to increase.

The problem at a time when the fully closed learning value is not updated will be explained with reference to FIG. 1. In FIG. 1, the unupdated throttle fully closed learning position is indicated by a double-dashed line, and the updated throttle fully closed learning position is indicated by a dashed line. The solid line indicates the desired throttle opening degree, and the dotted line indicates the throttle opening degree sensor detection value.

At a time point t1, the throttle starts closing operation, and at a time t2, the throttle reaches the mechanical fully closed position. However, in a direction in which the steady difference between the throttle opening degree sensor detection value and the desired throttle opening degree is cancelled, the throttle control apparatus continuously drives the throttle driving motor in a direction in which the throttle is being closed.

As a result, there has been a latent problem that continuous driving of the throttle driving motor causes the power consumption to increase and, in the worst case, causes the throttle driving motor or the motor drive circuit to overheat and burn out. This problem is posed also in the case where the fully opened learning value is left unupdated.

SUMMARY OF THE INVENTION

The present invention has been implemented in order to solve the foregoing problems; the objective thereof is to obtain a throttle learning control apparatus that can solve the latent problem in the fully closed learning and the fully opened learning to be implemented during an idling stop period.

After a self-shutoff delay abnormality occurs, fully closed learning and fully opened learning are implemented while an engine is operated, and the fully closed learning and the fully opened learning are implemented during an engine stall period.

The present invention relates to fully closed learning or fully opened learning and makes it possible to raise the reliability of an electronically-controlled throttle system. In addition, there can be suppressed waste of electric power, overheat burning of a throttle driving motor and a motor drive circuit, which occur when because a fully closed learning value or a fully opened learning value is not updated, the throttle driving motor is continuously driven. The fully closed learning or the fully opened learning is completed when it has been once implemented in a trip and, thereafter, the fully closed learning or the fully opened learning is not required in the trip, so that superfluous learning operation is suppressed and hence power consumption can be reduced.

The foregoing and other object, features, aspects, and advantages of the present invention will become more apparent from the following detailed description of the present invention when taken in conjunction with the accompanying drawings.

DETAILED DESCRIPTION OF THE PREFERRED EMBODIMENTS

Embodiment 1

Figure 1:
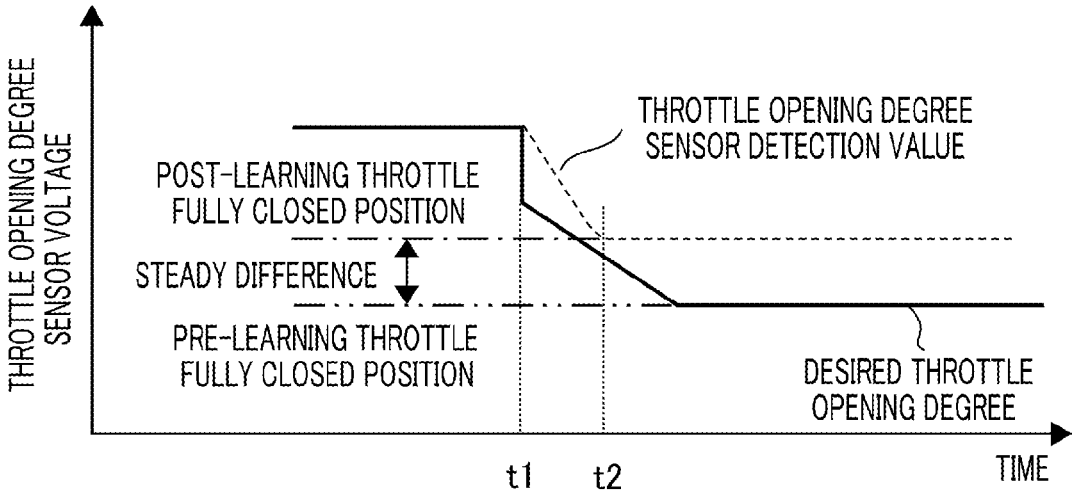
FIG. 1 is a timing chart representing throttle full closing operation at a time when fully closed learning value has not been updated.
Figure 2:
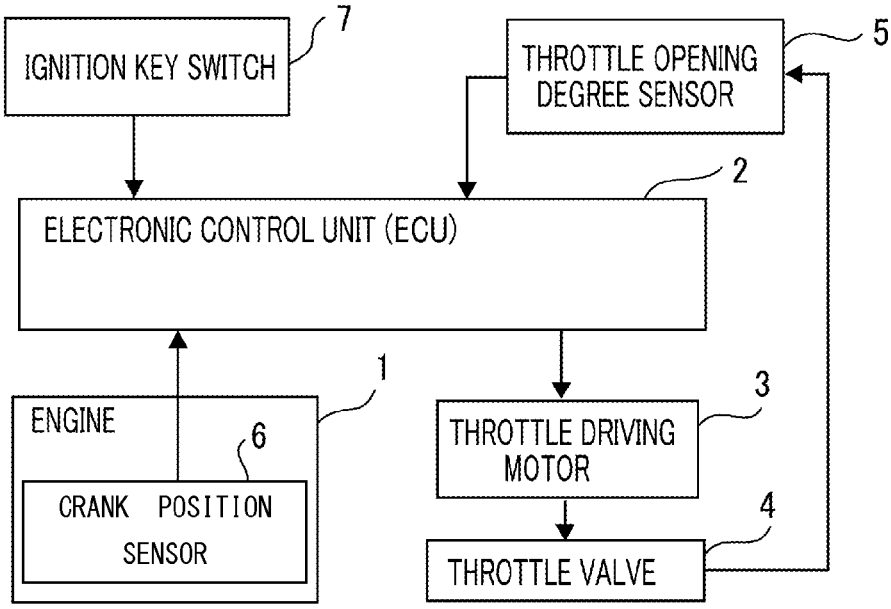
FIG. 2 is a block diagram illustrating the configuration including an engine and an electronically-controlled throttle system according to Embodiment 1 of the present invention.

FIG. 2 is a block diagram illustrating the configuration including an engine and an electronically-controlled throttle system according to Embodiment 1 of the present invention. In each of the following drawings, the same reference characters denote the same or similar constituent elements. In Embodiment 1, throttle fully closed learning will be explained.

An engine/electronically-controlled throttle system according to the present invention includes an engine 1, an electronic control unit (hereinafter, referred to as ECU) 2 that performs throttle control and engine control including idling stop control, a throttle driving motor 3 that operates in accordance with a command from ECU 2, a throttle valve (hereinafter, referred to as a throttle) 4 that is opening/closing-driven by the throttle driving motor 3, and a throttle opening degree sensor 5 that outputs a voltage as a throttle valve opening degree. ECU 2 is configures with various types of input/output interface circuits (unillustrated), a power-supply circuit (unillustrated), a clock oscillation circuit (unillustrated), a one-chip microcomputer (unillustrated), and the like. The one-chip microcomputer is configured with an A/D converter (unillustrated) that converts analogue signals inputted from various kinds of sensors into digital signals, various types of engine control programs including an idling stop control program, various types of engine control parameters, a ROM (unillustrated) that stores various types of tables and the like, a processor (unillustrated) that performs a control program, a RAM (unillustrated) that stores a variable and the like required at a time when a control program is implemented, a nonvolatile memory (unillustrated) that can hold information even when power supply to ECU 2 is cut off, and the like. ECU 2 updates a crank angle position with reference to a signal from a crank (rotating) position sensor 6 and drives a fuel injection device (unillustrated) at an appropriate crank angle position so as to inject and supply a fuel into the engine 1. ECU 2 drives an ignition apparatus (unillustrated) at an appropriate crank angle position and ignites a fuel-air mixture created from intake air and injection fuel so as to cause the crankshaft to generate combustion torque. When turned on, an ignition key switch 7 starts to supply electric power to ECU 2.

Figure 3:
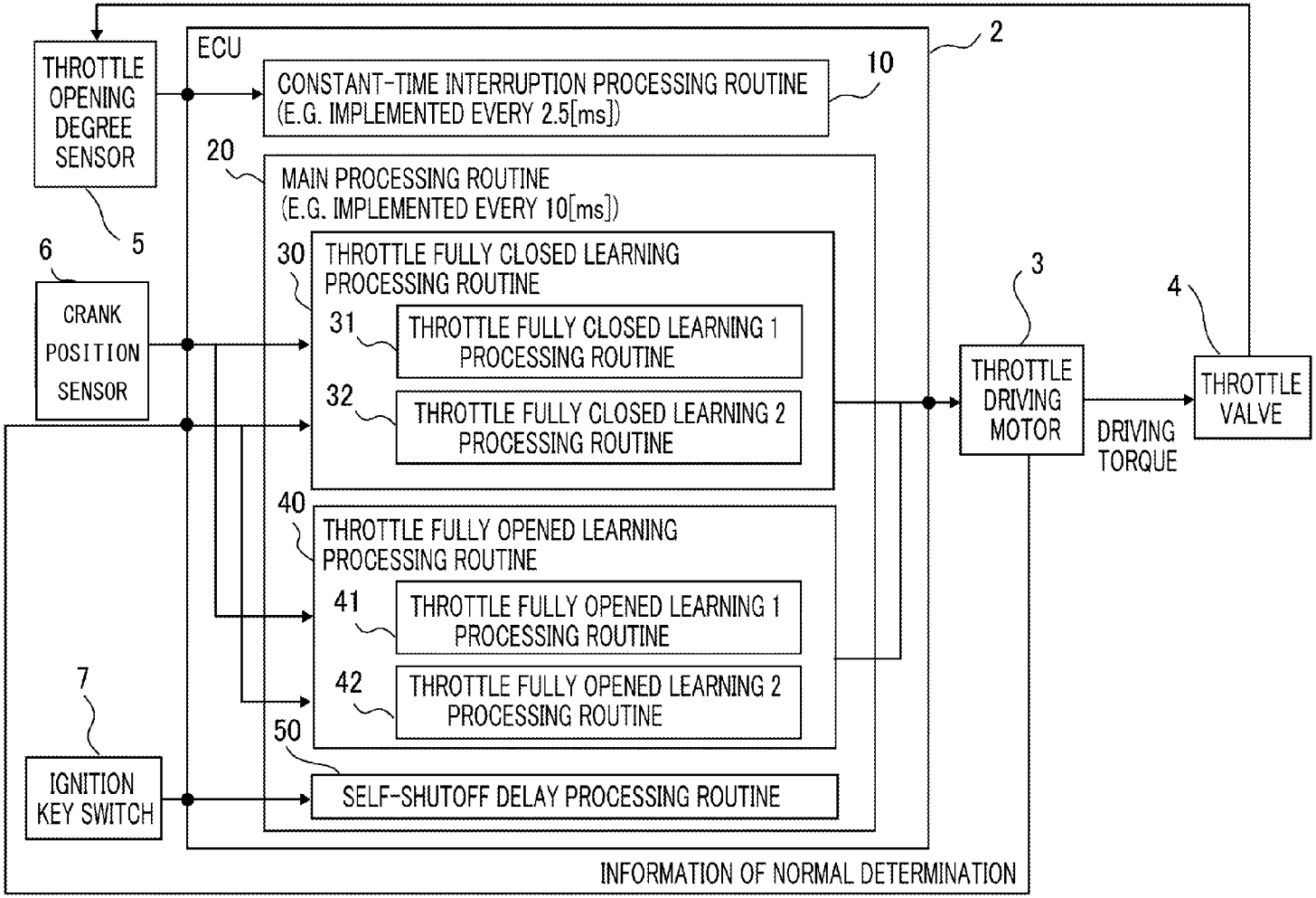
FIG. 3 is a block diagram illustrating the control in a throttle learning control apparatus according to Embodiment 1 of the present invention.

FIG. 3 is a block diagram illustrating the control in a throttle learning control apparatus according to Embodiment 1 of the present invention.

The throttle driving motor 3, the throttle opening degree sensor 5, the crank (rotating) position sensor 6, and the ignition key switch 7 are connected with ECU 2. A constant-time interruption processing routine 10 and a main processing routine 20 are stored in a ROM (unillustrated) incorporated in the one-chip microcomputer in ECU 2. The main processing routine 20 includes a throttle fully closed learning processing routine 30, a throttle fully opened learning processing routine 40, and a self-shutoff delay processing routine 50. The throttle fully closed learning processing routine 30 includes a processing routine 31 of a throttle fully closed learning 1 (hereinafter, referred to as a first throttle fully closed learning) and a processing routine 32 of a throttle fully closed learning 2 (hereinafter, referred to as a second throttle fully closed learning); the throttle fully opened learning processing routine 40 includes a processing routine 41 of a throttle fully opened learning 1 (hereinafter, referred to as a first throttle fully opened learning) and a processing routine 42 of a throttle fully opened learning 2 (hereinafter, referred to as a second throttle fully opened learning).

When the ignition key switch 7 of an automobile is turned on and power supply to ECU 2 is started, the constant-time interruption processing routine 10 and the main processing routine 20 are separately performed by ECU 2; however, priority of processing is given to the constant-time interruption processing routine 10. Then, when the ignition key switch 7 is turned off, ECU 2 performs for a predetermined time the self-shutoff delay processing routine 50 in the main processing routine 20; after the predetermined time has elapsed, power supply to ECU 2 is cut off.

Figure 4:
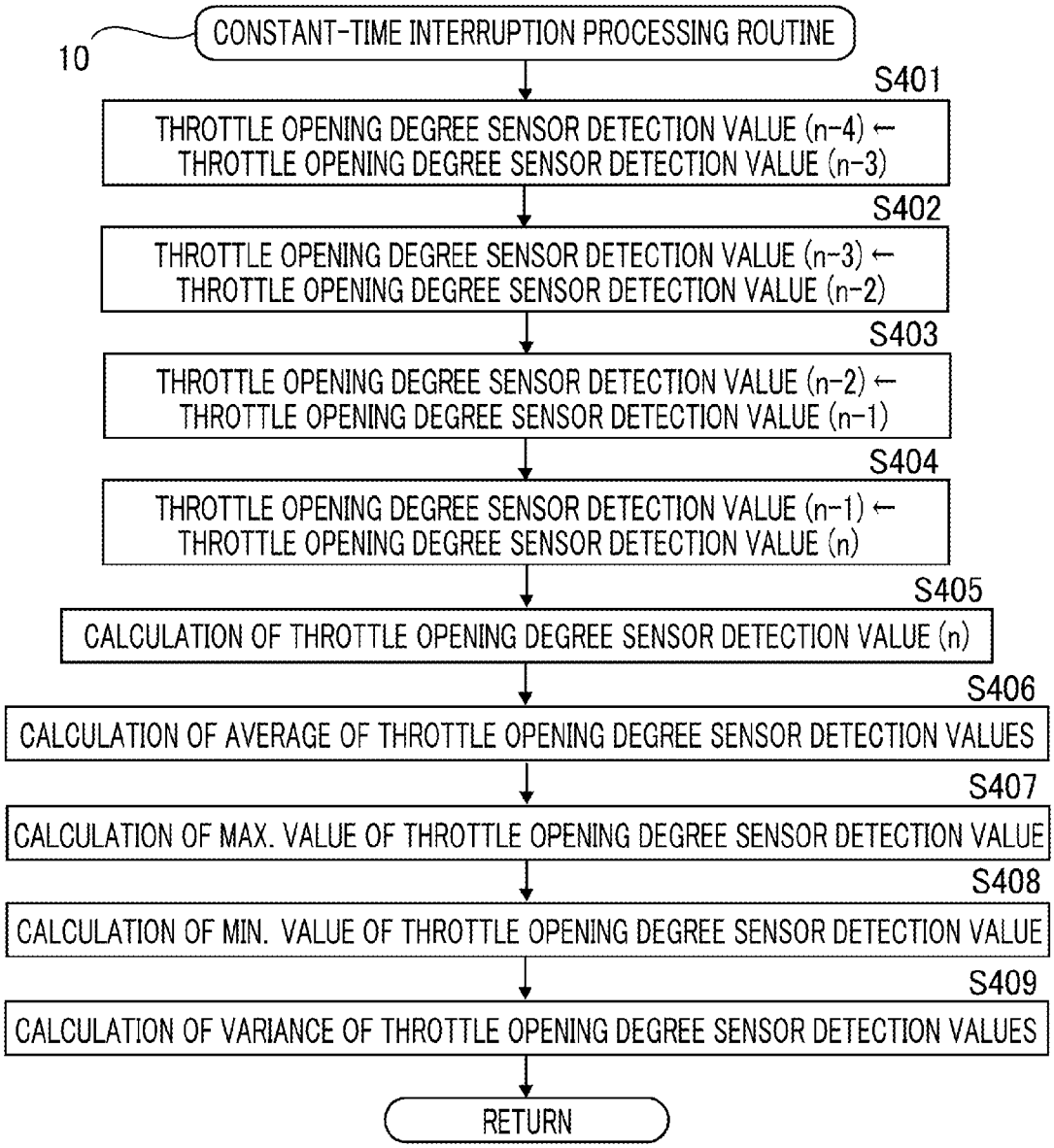
FIG. 4 is a flowchart representing the flow of a constant-time interruption processing routine performed in an embodiment of the present invention.

Next, the constant-time interruption processing routine 10 will be explained with reference to FIG. 4. The constant-time interruption processing routine 10 is called, for example, every 2.5 [ms].

At first, in the step S401, ECU 2 sets a throttle opening degree sensor detection value (n−3), as the four times previous throttle opening degree sensor detection value (n−4).

Similarly, in the step S402, ECU 2 sets a throttle opening degree sensor detection value (n−23), as the thrice previous throttle opening degree sensor detection value (n−3).

Similarly, in the step S403, ECU 2 sets a throttle opening degree sensor detection value (n−1), as the twice previous throttle opening degree sensor detection value (n−2).

Similarly, in the step S404, ECU 2 sets a throttle opening degree sensor detection value (n), as the immediately previous throttle opening degree sensor detection value (n−1).

Here, (n−4), (n−3), (n−2), and (n−1) denote the four times previous (10 [ms] previous), thrice previous (7.5 [ms] previous), twice previous (5 [ms] previous), and immediately previous (2.5 [ms] previous) throttle opening degree sensor detection values, respectively; the after-mentioned (n) denotes the present throttle opening degree sensor detection value.

The processing in each of the steps S401 through 404 is performed based on the following reasons.

That is to say, immediately before the step 401 is implemented, the contents of the throttle opening degree sensor detection value (n−3) is the four times previous (10 [ms] previous) throttle opening degree detection value; similarly, immediately before the step 402 is implemented, the contents of the throttle opening degree sensor detection value (n−2) is the thrice times previous (7.5 [ms] previous) throttle opening degree detection value; similarly, immediately before the step 403 is implemented, the contents of the throttle opening degree sensor detection value (n−1) is the twice times previous (5 [ms] previous) throttle opening degree detection value; similarly, immediately before the step 404 is implemented, the contents of the throttle opening degree sensor detection value (n) is the immediately previous (2.5 [ms] previous) throttle opening degree detection value.

Next, in the step S405, ECU 2 calculates the throttle opening degree sensor detection value (n) at the present constant-time interruption processing timing, based on an input signal from the throttle opening degree sensor 5.

Next, in the step S406, in accordance with the equation (1) below, ECU 2 calculates the average value $Th_{AVE}$ of throttle opening degree sensor detection values, based on the throttle opening degree sensor detection values (n) through (n−4).

$$Th_{AVE} = \frac{1}{5}\sum_{i=0}^{4} \text{throttle opening sensor detection value } (n-i) \tag{1}$$

In the equation (1), when i=0, the throttle opening degree sensor detection value is described as (n−0); it is assumed that this denotes the throttle opening degree sensor detection value (n) in the step S405. This applies to the following explanation.

Next, in the step S407, ECU 2 calculates the maximum value of throttle opening degree sensor detection values, based on the throttle opening degree sensor detection values (n) through (n−4).

Next, in the step S408, ECU 2 calculates the minimum value of throttle opening degree sensor detection values, based on the throttle opening degree sensor detection values (n) through (n−4).

At last, in the step S409, in accordance with the equation (2) below, ECU 2 calculates the variance $\sigma^2$ of throttle opening degree sensor detection values and ends the routine. A variance is an index that expresses how data pieces are converged; the smaller a variance is, the higher the convergence level of throttle opening degree detection values is.

$$\sigma^2 = \frac{1}{5}\sum_{i=0}^{4} (\text{throttle opening sensor detection value } (n-i) - Th_{AVE})^2 \tag{2}$$

Figure 5A:
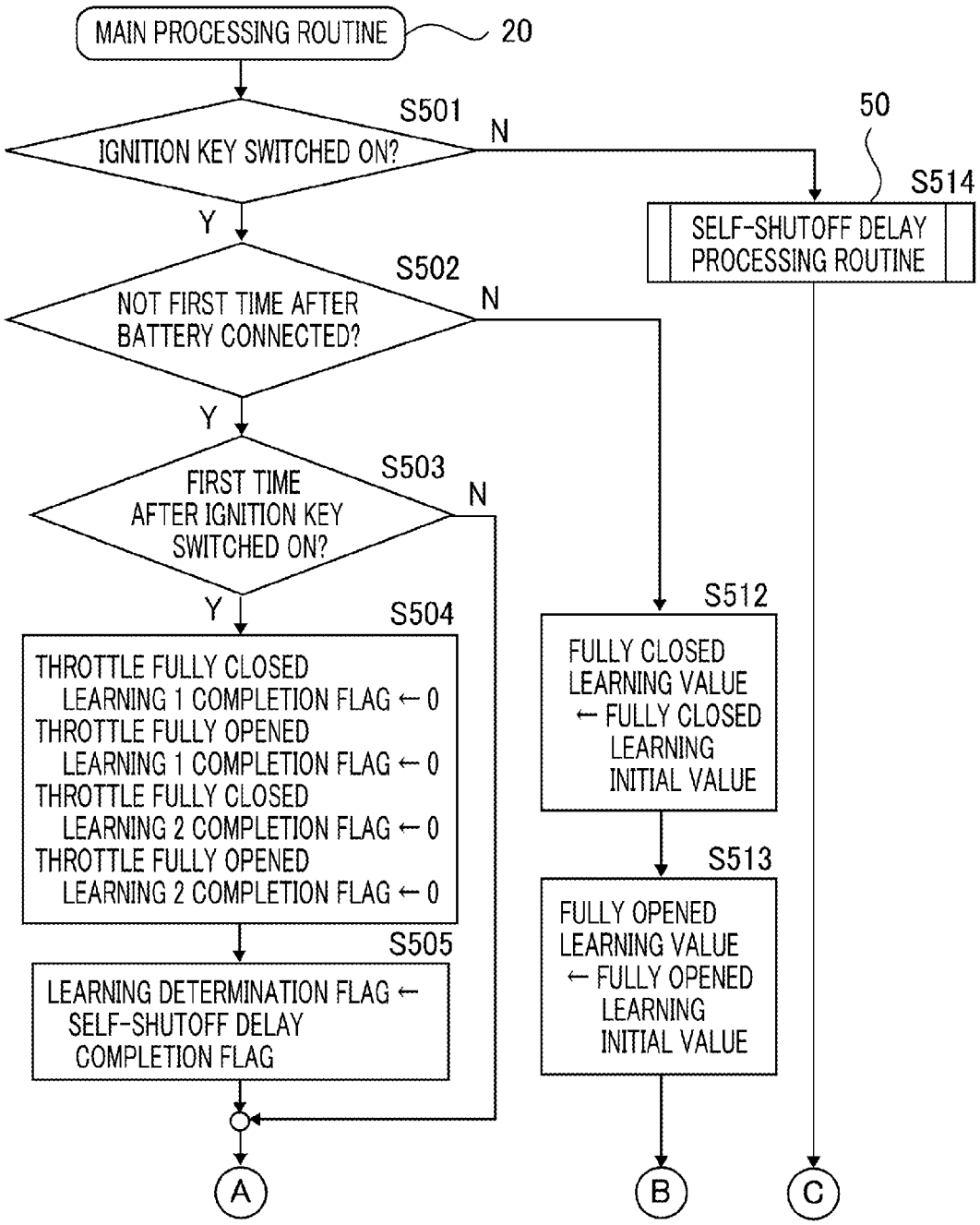
FIGS. 5A and 5B together form a flowchart representing the flow of a main processing routine performed in an embodiment of the present invention.
Figure 5B:
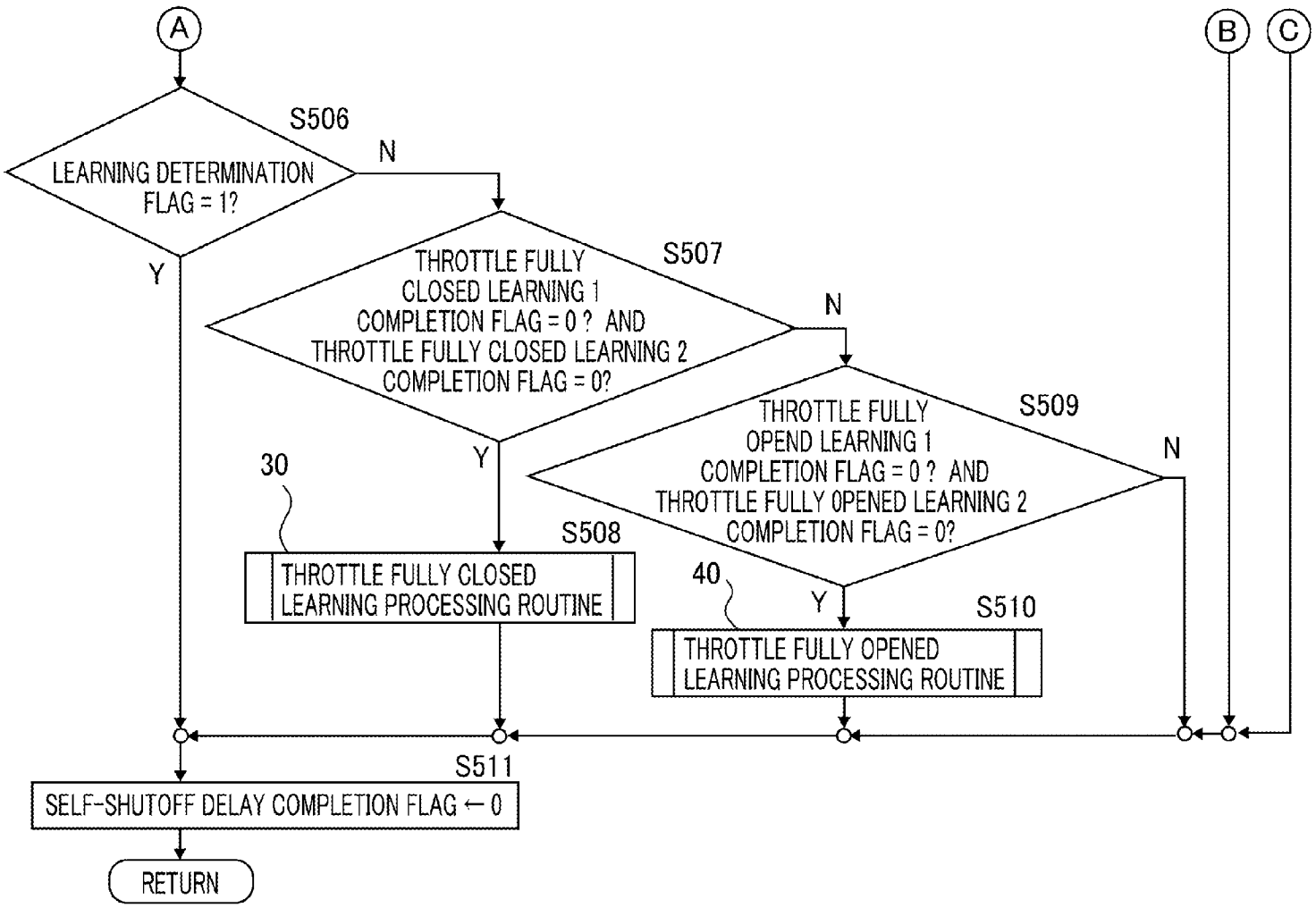

Next, the main processing routine 20 will be explained with reference to FIG. 5. The main processing routine 20 is called, for example, every 10 [ms].

At first, in the step S501, ECU 2 determines whether or not the ignition key switch is on; in the case where the ignition key switch is on ("Y" in S501), the step S501 is followed by the step S502, and in the case where the ignition key switch is not on ("N" in S501), the step S501 is followed by the step S514.

In the step S514, ECU 2 calls the self-shutoff delay processing routine 50, described later, and then ends the routine.

In the step S502, ECU 2 determines whether or not the main processing routine 20 is not implemented for the first time; in the case where the main processing routine 20 is not implemented for the first time ("Y" in S502), the step S502 is followed by the step S503, and in the case where the main processing routine 20 is implemented for the first time ("N" in S502), the step S502 is followed by the step S512.

Next, in the step S503, ECU 2 determines whether or not the main processing routine 20 is implemented for the first time after the ignition key switch has turned on; in the case where the main processing routine 20 is implemented for the first time after the ignition key switch has turned on ("Y" in S503), the step S503 is followed by the step S504, and in the case where the main processing routine 20 is not implemented for the first time after the ignition key switch has turned on ("N" in S503), the step S503 is followed by the step S506.

Next, in the step S504, ECU 2 sets all of a throttle fully closed learning 1 completion flag, a throttle fully opened learning 1 completion flag, a throttle fully closed learning 2 completion flag, and a throttle fully opened learning 2 completion flag to 0 (uncompleted).

Next, in the step S505, ECU 2 stores the value of an after-mentioned self-shutoff delay completion flag in a learning determination flag.

Next, in the step S506, ECU 2 reads the value of the learning determination flag; in the case where the value of the learning determination flag is "1 (completed)" ("Y" in S506), the step S506 is followed by the step S511, and in the case where the value of the learning determination flag is "0 (uncompleted)" ("N" in S506), the step S506 is followed by the step S507.

The self-shutoff delay completion flag is information to be stored in a nonvolatile memory (unillustrated); when the value of the self-shutoff delay completion flag is "1 (completed)", it suggests that the self-shutoff delay processing in the immediately previous trip has normally be completed.

Accordingly, in general, with regard to the self-shutoff delay completion flag, the value thereof at a time when the step S506 is established is read; however, when the value of the self-shutoff delay completion flag is "0 (uncompleted)", it suggests that the self-shutoff delay processing in the immediately previous trip has abnormally be completed.

Next, in the step S511, ECU 2 clears the self-shutoff delay completion flag to "0 (uncompleted)" and then ends the routine.

In the step S507, ECU 2 reads the values of the throttle fully closed learning 1 completion flag and the throttle fully closed learning 2 completion flag; in the case where both the values of the throttle fully closed learning 1 completion flag and the throttle fully closed learning 2 completion flag are "0 (uncompleted)" ("Y" in S507), the step S507 is followed by the step S508; in the case where any one of the values of the throttle fully closed learning 1 completion flag and the throttle fully closed learning 2 completion flag is not "0" ("N" in S507), the step S507 is followed by the step S509.

Next, in the step S508, ECU 2 calls the throttle fully closed learning processing routine 30, described later, and then ends the routine.

Next, in the step S509, ECU 2 reads the values of the throttle fully opened learning 1 completion flag completion flag and the throttle fully opened learning 2 completion flag; in the case where both the values of the throttle fully opened learning 1 completion flag and the throttle fully opened learning 2 completion flag are "0 (uncompleted)" ("Y" in S509), the step S509 is followed by the step S510; in the case where any one of the values of the throttle fully opened learning 1 completion flag and the throttle fully opened learning 2 completion flag is not "0" ("N" in S509), the step S509 is followed by the step S511.

Next, in the step S510, ECU 2 calls the throttle fully opened learning processing routine 40, described later, and then ends the routine.

In the step S512, ECU 2 substitutes a throttle fully closed learning initial value for the fully closed learning value; the fully closed learning value is information to be stored in a nonvolatile memory (unillustrated).

Next, in the step S513, ECU 2 substitutes a throttle fully opened learning initial value for the fully opened learning value and then ends the routine; the fully opened learning value is also information to be stored in a nonvolatile memory (unillustrated).

Figure 6:
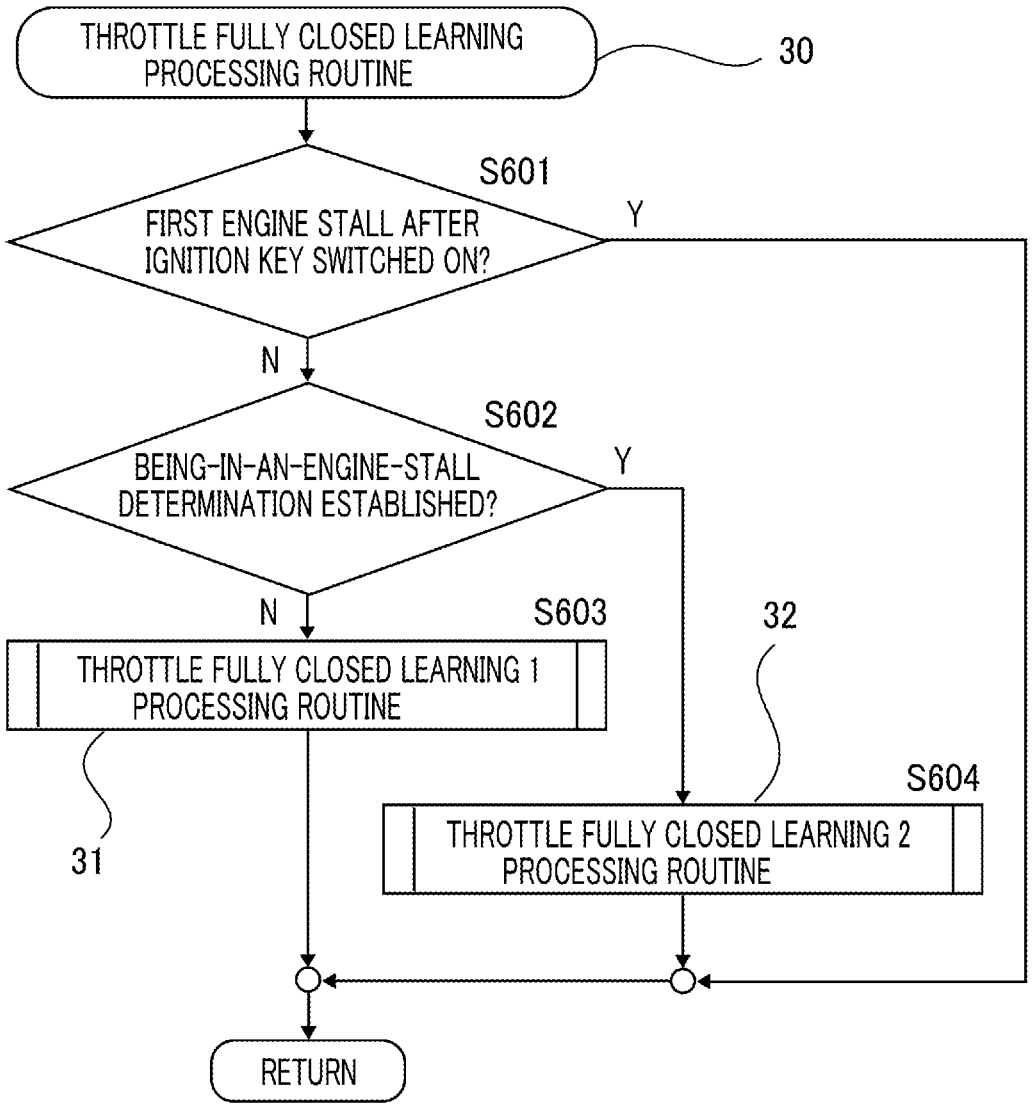
FIG. 6 is a flowchart representing the flow of a throttle fully closed learning processing routine performed in an embodiment of the present invention.

FIG. 6 is the flow of the throttle fully closed learning processing routine 30.

At first, in the step S601, ECU 2 determines whether or not the present engine stall is the first one after the ignition key switch has turned on; in the case where the present engine stall is the first one after the ignition key switch has turned on ("Y" in S601), the routine is ended; in the case where the present engine stall is not the first one after the ignition key switch has turned on ("N" in S601), the step S601 is followed by the step S602.

Next, in the step S602, ECU 2 determines whether or not a being-in-an-engine-stall determination has been established.

As an example, the being-in-an-engine-stall determination is established when the period in which the crank (rotating) position sensor 6 does not input a crank signal to ECU 2 has continued for a predetermined time.

In the case where the being-in-an-engine-stall determination has not been established ("N" in S602), the step S602 is followed by the step S603, and ECU 2 calls the throttle fully closed learning 1 processing routine 31, described later, and then ends the routine. In contrast, in the case where the being-in-an-engine-stall determination has been established ("Y" in S602), the step S602 is followed by the step S604, and ECU 2 calls the throttle fully closed learning 2 processing routine 32, described later, and then ends the routine.

Next, the self-shutoff delay processing routine 50, which is called at the end of the trip, will be explained.

When the driver turns off the ignition key switch 7, the determination result of the step S501 in the main processing routine 20 becomes "N"; then, the self-shutoff delay processing routine 50 in the step S514 is called.

Figure 7:
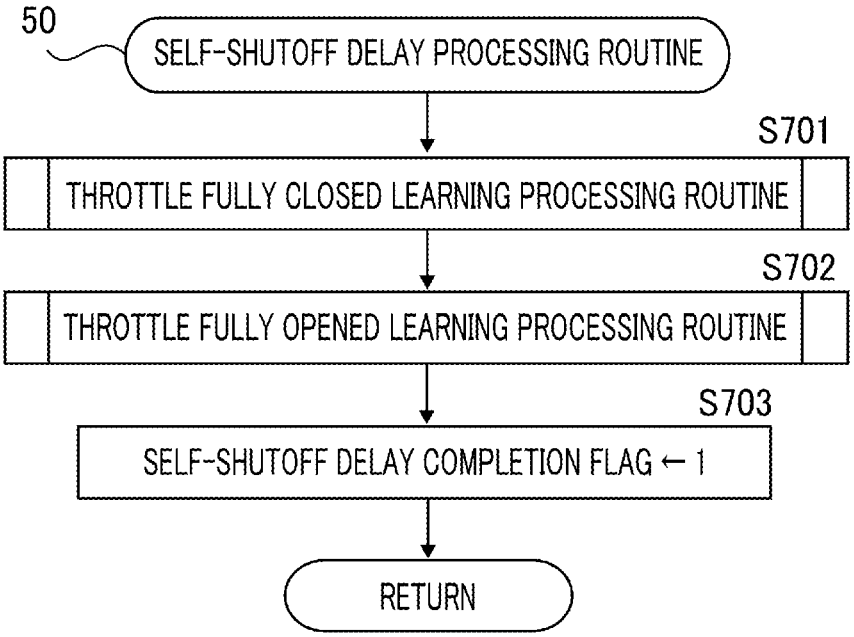
FIG. 7 is a flowchart representing the flow of a self-shutoff delay processing routine performed in an embodiment of the present invention.

In the self-shutoff delay processing routine represented in FIG. 7, only the processing items, among various processing items implemented during the self-shutoff delay period, that are related to the fully closed learning and the fully opened learning are described. When a self-shutoff delay abnormality occurs, the self-shutoff delay processing routine 50 is not completely implemented.

At first, in the step S701, ECU 2 drives the throttle valve to the fully closed position and then updates the fully closed learning value. It is described that in the step S701, the throttle fully closed learning processing routine is called; however, because this is a publicly known technology, the detailed explanation for the processing will be omitted.

Next, in the step S702, ECU 2 drives the throttle valve to the fully opened position and then updates the fully opened learning value. It is described that in the step S702, the throttle fully opened learning processing routine is called; however, because this is a publicly known technology, the detailed explanation for the processing will be omitted, as is the case with the fully closed learning.

At last, in the step S703, ECU 2 sets the self-shutoff delay completion flag to "1 (completed)" and then ends the routine.

Figure 8:
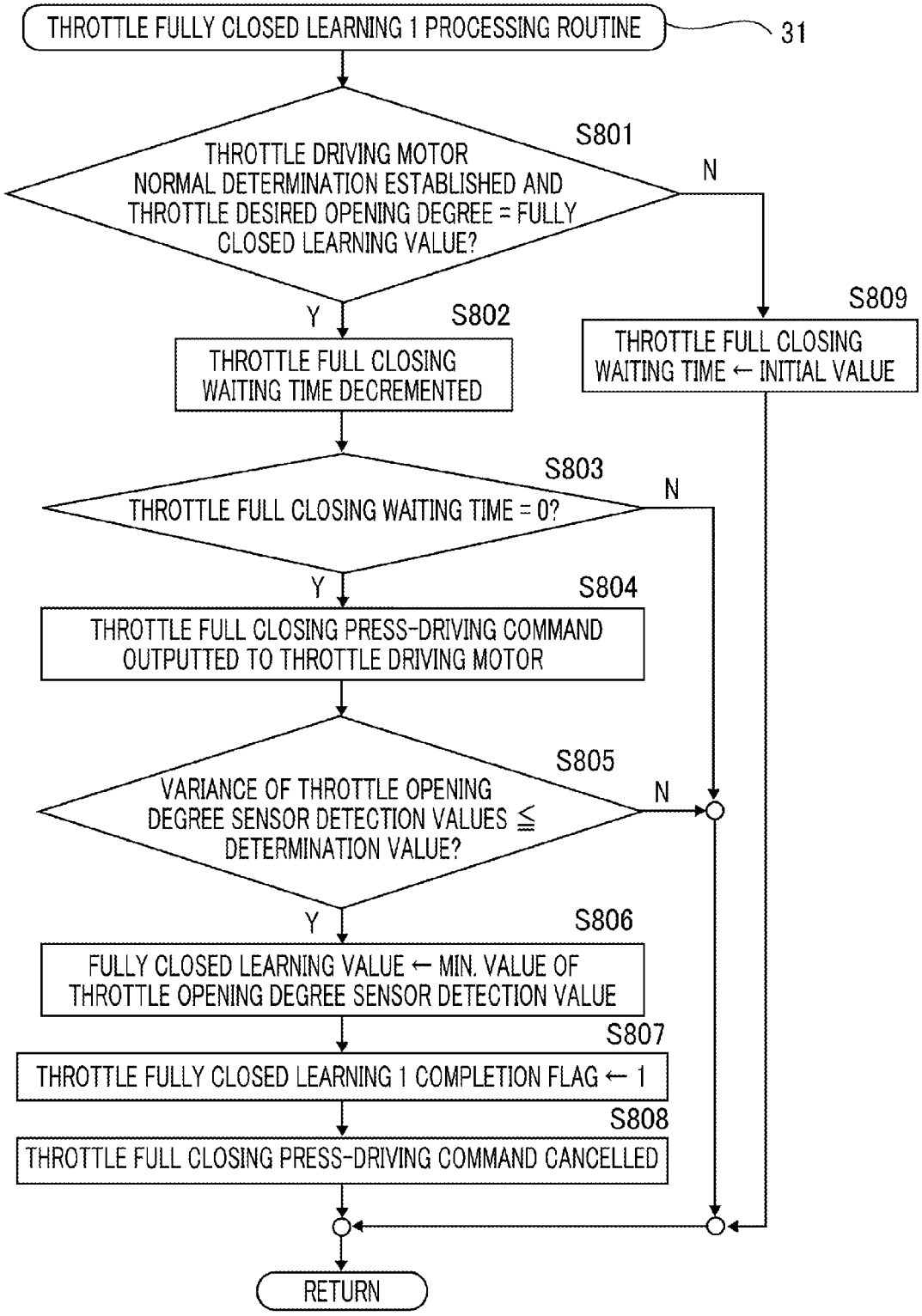
FIG. 8 is a flowchart representing the flow of the processing routine in a throttle fully closed learning 1 performed in an embodiment of the present invention.

FIG. 8 is the flow of the throttle fully closed learning 1 processing routine 31.

At first, in the step S801, ECU 2 determines whether or not a predetermined determination on the normality of the throttle driving motor has been established and the throttle desired opening degree has coincided with the fully closed learning value.

In the case where the determination on the normality of the throttle driving motor has been established and the throttle desired opening degree has coincided with the fully closed learning value ("Y" in S801), the step S801 is followed by the step S802; however, in the case where the determination on the normality of the throttle driving motor has not been established or the throttle desired opening degree has not coincided with the fully closed learning value ("N" in S801), the step S801 is followed by the step S809.

When as an example, ECU 2 detects an abnormality such as a short-to-power fault, a short-to-ground fault, or the like of the output terminal (unillustrated) of the throttle driving motor 3, the determination on the normality of the throttle driving motor is not established; however, the detailed explanation therefor will be omitted here.

In the step S809, ECU 2 sets a throttle full closing waiting time to an initial value (e.g., 0.2 [sec]) and then ends the routine.

On the other hand, ECU 2 decrements the throttle full closing waiting time in the step S802.

Next, in the step S803, ECU 2 determines whether or not the throttle full closing waiting time has reached "0"; in the case where the throttle full closing waiting time has reached "0" ("Y" in S803), the step S803 is followed by the step S804, and in the case where the throttle full closing waiting time has not reached "0" ("N" in S803), the routine is ended.

In the step S804, ECU 2 outputs a throttle full closing press-driving command to the throttle driving motor 3.

As a result, the throttle valve 4 is pressed to the mechanical fully closed position; however, because the throttle has already been stabilized at the fully closed position or approximately at the fully closed position before the step S804 is implemented, the implementation of the step S804 provides no effect to the engine control.

Next, in the step S805, ECU 2 refers to the variance of throttle opening degree sensor detection values calculated in the immediately previous constant-time interruption processing routine 10; in the case where the variance is the same as or smaller than a determination value (e.g., 0.005) ("Y" in S805), ECU 2 determines that the sampled throttle opening degree sensor detection values have sufficiently converged, and the step S805 is followed by the step S806; however, in the case where the variance exceeds the determination value (e.g., 0.005) ("N" in S805), ECU 2 determines that the sampled throttle opening degree sensor detection values have not sufficiently converged, and then ends the routine.

Next, in the step S806, ECU 2 sets the fully closed learning value to the throttle opening degree sensor detection minimum value calculated in the immediately previous constant-time interruption processing routine 10. In this step, the fully closed learning value is updated.

Next, in the step S807, ECU 2 sets the throttle fully closed learning 1 completion flag to "1 (completed)".

At last, in the step S808, ECU 2 cancels the throttle full closing press-driving command that has been issued to the throttle driving motor 3, and then ends the routine.

Figure 9:
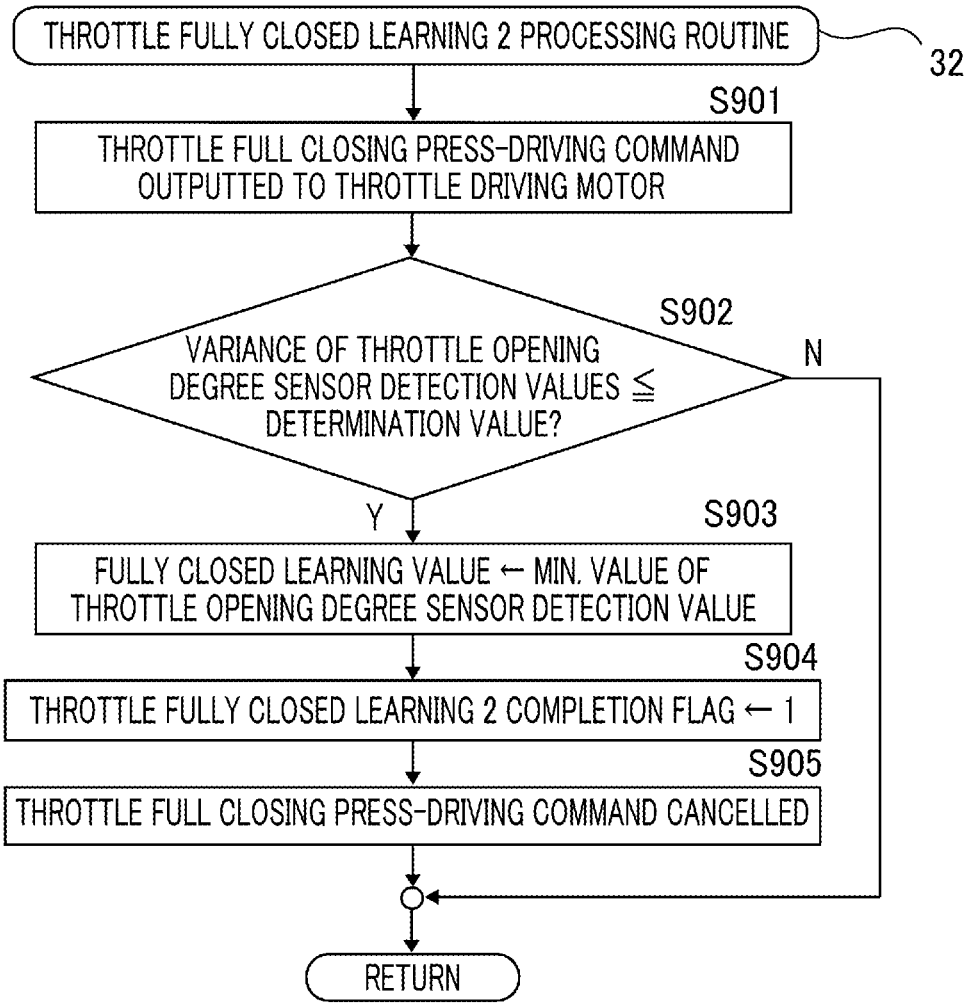
FIG. 9 is a flowchart representing the flow of the processing routine in a throttle fully closed learning 2 performed in an embodiment of the present invention.

FIG. 9 is the flow of the throttle fully closed learning 2 processing routine 32.

At first, in the step S901, ECU 2 outputs the throttle full closing press-driving command to the throttle driving motor 3.

As a result, the throttle valve 4 is pressed to the mechanical fully closed position; however, because the engine 1 has already been stabilized to the engine stall condition before the step S901 is implemented, the implementation of the step S901 provides no effect to the control.

Next, in the step S902, ECU 2 refers to the variance of throttle opening degree sensor detection values calculated in the immediately previous constant-time interruption processing routine 10; in the case where the variance is the same as or smaller than a determination value (e.g., 0.005) ("Y" in S902), ECU 2 determines that the sampled throttle opening degree sensor detection values have sufficiently converged, and the step S902 is followed by the step S903; however, in the case where the variance exceeds the determination value (e.g., 0.005) ("N" in S902), ECU 2 determines that the sampled throttle opening degree sensor detection values have not sufficiently converged, and then ends the routine.

Next, in the step S903, ECU 2 sets the fully closed learning value to the throttle opening degree sensor detection minimum value calculated in the immediately previous constant-time interruption processing routine 10. In this step, the fully closed learning value is updated.

Next, in the step S904, ECU 2 sets the throttle fully closed learning 2 completion flag to "1 (completed)".

At last, in the step S905, ECU 2 cancels the throttle full closing press-driving command that has been issued to the throttle driving motor 3, and then ends the routine.

Figure 11:
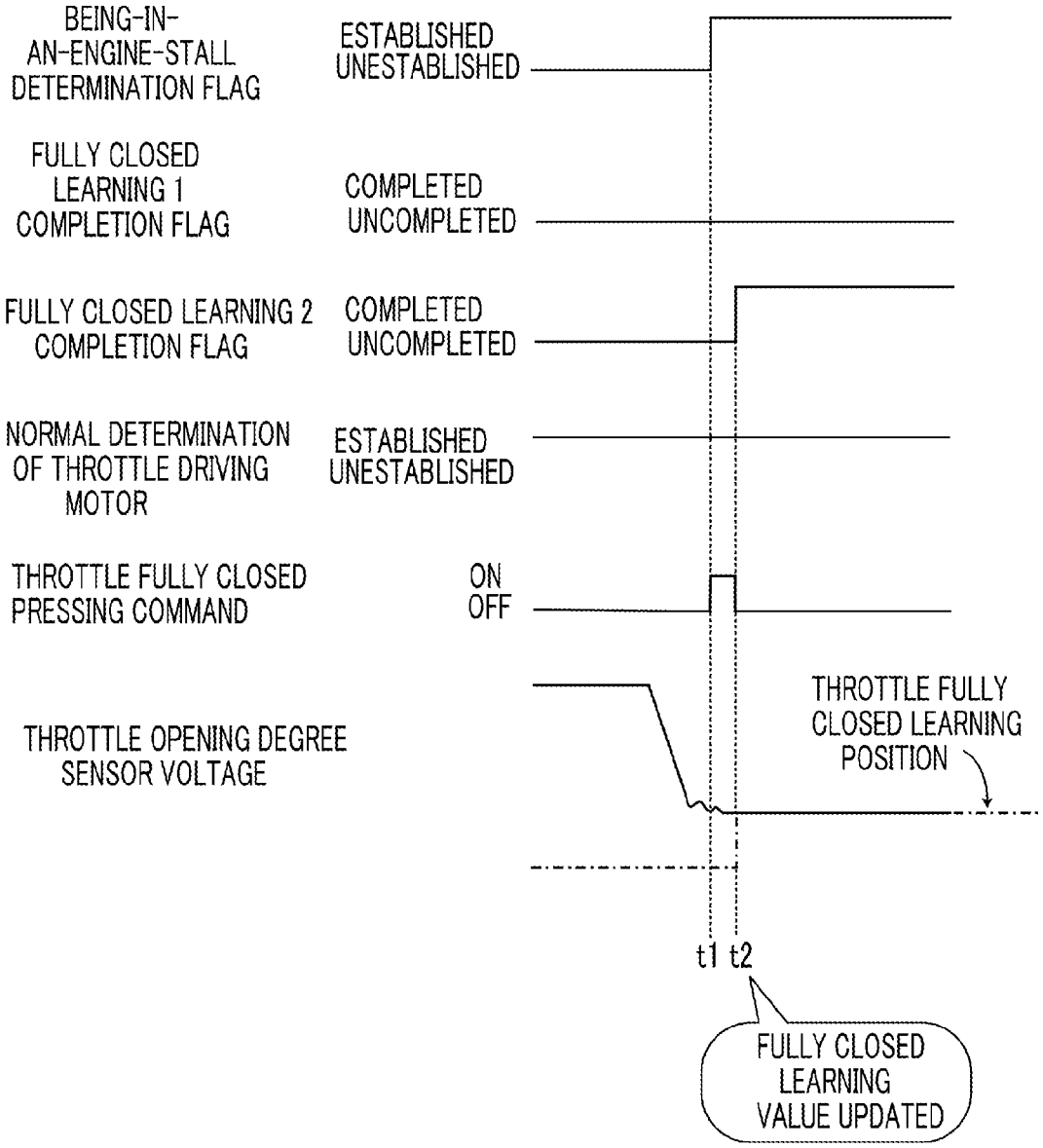
FIG. 11 is a timing chart representing the operation of fully closed learning 2 according to the present invention.
Figure 12:
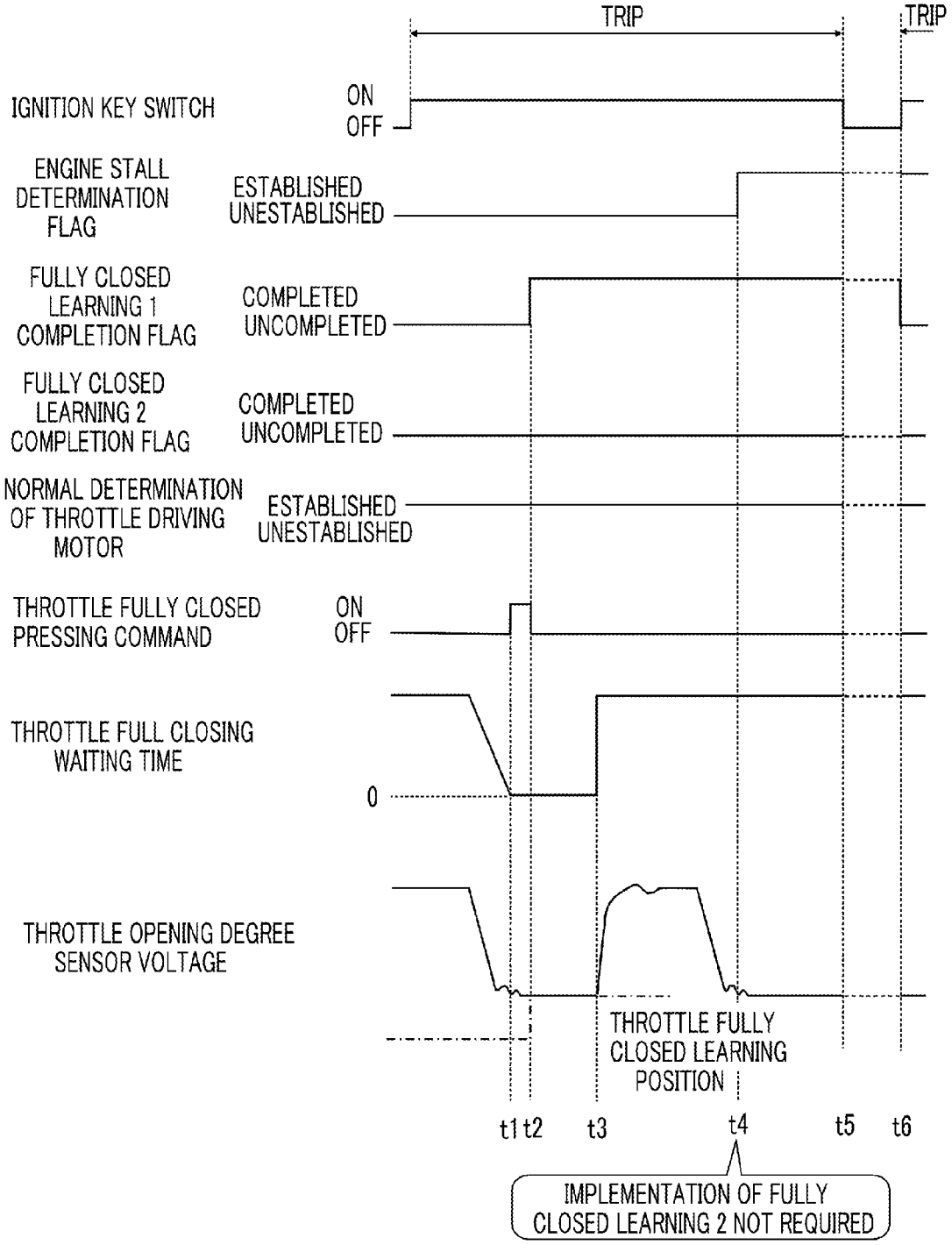
FIG. 12 is a timing chart representing the operation of fully closed learning within one trip according to the present invention.

An example of operation of Embodiment 1 described above will be represented in FIGS. 10 through 12. Each of FIGS. 10 through 12 represents the trip at a time after a self-shutoff delay abnormality has been detected.

Figure 10:
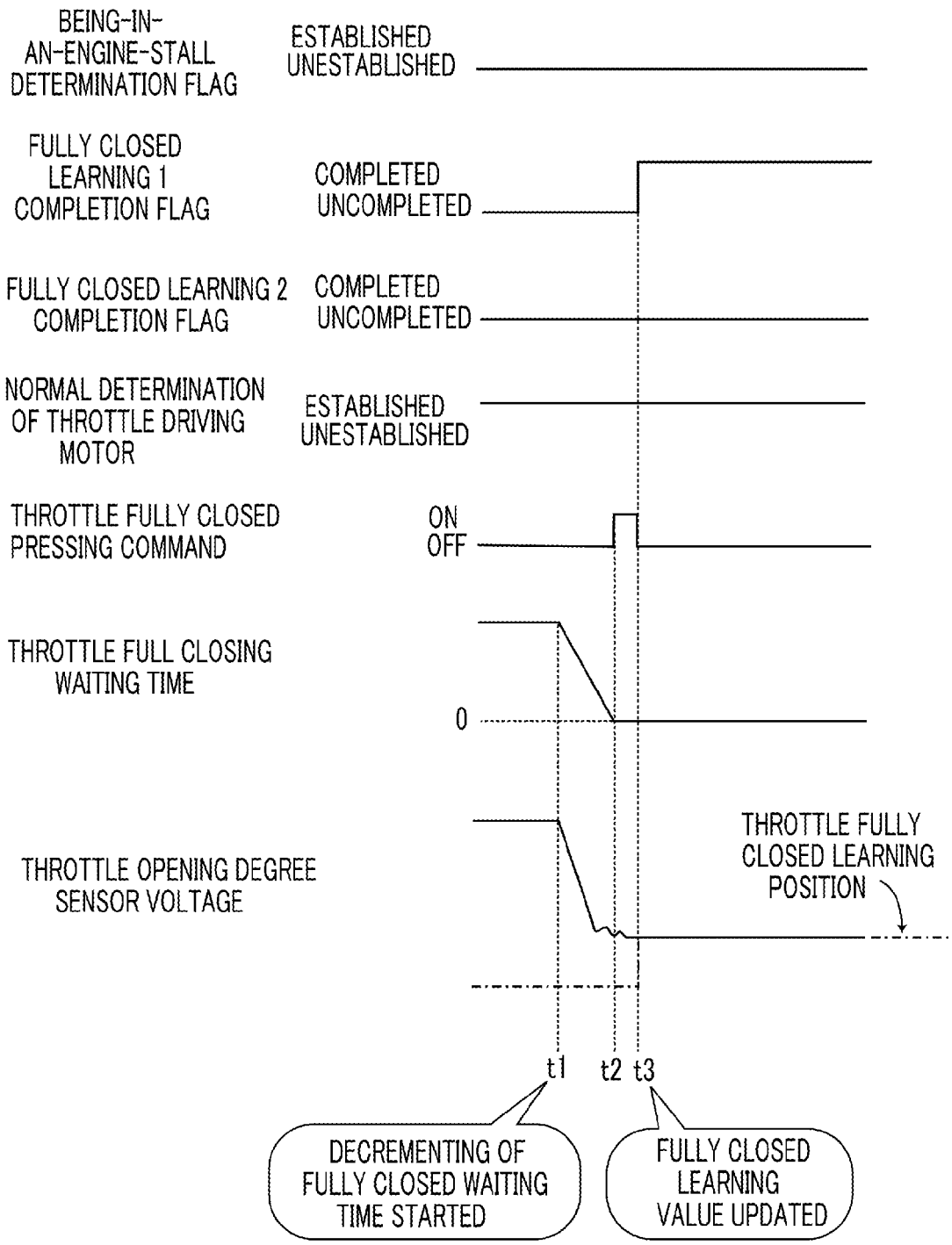
FIG. 10 is a timing chart representing the operation of fully closed learning 1 according to the present invention.

FIG. 10 represents an operation timing chart of the fully closed learning 1 based on the throttle fully closed learning 1 processing routine 31. In FIG. 10, it is assumed that the dashed line after the time point t3 is a throttle fully closed learning position that is newly learned by the ECU 2.

In the case where in the main processing routine 20, neither the fully closed learning 1 nor the fully closed learning 2 has been completed ("Y" in S507), the throttle fully closed learning processing routine 30 in the step S508 is always called. At a time point t1 in FIG. 10, the being-in-an-engine-stall determination is not established ("N" in S602); therefore, the throttle fully closed learning 1 processing routine 31 in the step S603 is called.

In the case where in the throttle fully closed learning 1 processing routine 31, the throttle desired opening degree coincides with the fully closed learning value and the throttle driving motor is normal ("Y" in S801), ECU 2 starts to decrement the throttle full closing waiting time (S802 is implemented). After that, when at a time point t2 in FIG. 10, the throttle full closing waiting time reaches "0" ("Y" in S803), ECU 2 outputs the throttle full closing press-driving command to the throttle driving motor 3 (S804 is implemented). Then, when at the time point t3 in FIG. 10, the throttle opening degree detection values converge ("Y" in S805), ECU 2 updates the fully closed learning value (S806 is implemented) and, at the same time, sets the fully closed learning 1 completion flag (S807 is implemented); then, the throttle full closing press-driving command is cancelled (S808 is implemented).

Next, FIG. 11 represents a timing chart of the fully closed learning 2 based on the throttle fully closed learning 2 processing routine 32. In FIG. 11, it is assumed that the dashed line after a time point t2 is a throttle fully closed learning position that is newly learned by the ECU 2.

In the case where in the main processing routine 20, neither the fully closed learning 1 nor the fully closed learning 2 has been completed ("Y" in S507), the throttle fully closed learning processing routine 30 in the step S508 is called. At a time point t1 in FIG. 11, the being-in-an-engine-stall determination is established ("Y" in S602); therefore, the throttle fully closed learning 2 processing routine 32 in the step S604 is called.

In the throttle fully closed learning 2 processing routine 32, ECU 2 outputs the throttle full closing press-driving command to the throttle driving motor 3 (S901 is implemented). Then, when at the time point t2 in FIG. 11, the throttle opening degree detection values converge ("Y" in S902), ECU 2 updates the fully closed learning value (S903 is implemented) and, at the same time, sets the fully closed learning 2 completion flag (S904 is implemented); then, the throttle full closing press-driving command is cancelled (S905 is implemented).

Next, FIG. 12 represents an example of whether or not the fully closed learning 1 and the fully closed learning 2 are implemented in one trip. FIG. 12 represents a situation in which the fully closed learning 1 is firstly started.

Here, it is defined that a trip is the section between the timing at which the ignition key switch is turned on and the timing at which the ignition key switch is turned off and hence the power supply relay in the electronic control unit is cut off.

In the case where in the main processing routine 20, neither the fully closed learning 1 nor the fully closed learning 2 has been completed ("Y" in S507), the throttle fully closed learning processing routine 30 in the step S508 is always called. The being-in-an-engine-stall determination is not established ("N" in S602); therefore, the throttle fully closed learning 1 processing routine 31 in the step S603 is called.

When at a time point t1 in FIG. 12, the throttle full closing waiting time reaches "0" ("Y" in S803), ECU 2 outputs the throttle full closing press-driving command to the throttle driving motor 3 (S804 is implemented). Then, when at a time point t2, the throttle opening degree detection values converge ("Y" in S805), ECU 2 updates the fully closed learning value (S806 is implemented) and, at the same time, sets the fully closed learning 1 completion flag (S807 is implemented); then, the throttle full closing press-driving command is cancelled (S808 is implemented), so that the throttle fully closed learning 1 processing routine 31 is ended.

After that, at a time point t3 in FIG. 12, the throttle is opened again; then at a time point t4, the engine stall condition is established due to an idling stop. However, because at the time point t4, the throttle fully closed learning 1 completion flag has already been set to "1", the result of the step S507 of the main processing routine 20 becomes "N"; thus, the fully closed learning 2 included in the step S508 of the main processing routine 20 is not implemented. As a result, ECU 2 can suppress superfluous fully closed learning.

After that, when at a time point t5 in FIG. 12, the ignition key switch 7 is turned off, power supply to ECU 2 is cut off due to a self-shutoff delay abnormality and hence the value of the fully closed learning 1 becomes indeterminate (indicated by a dotted line); however, the value of the fully closed learning 1 is reset to "0" (uncompleted) at a time point t6, which is the foremost point of the next trip (in S504 of the main processing routine 20).

Embodiment 2

In Embodiment 2, throttle fully opened learning will be explained.

FIGS. 2 through 7 and FIG. 7 are block diagrams illustrating the configurations of an electronically-controlled throttle system and an engine, and flowcharts representing a constant-time interruption processing routine, a main processing routine, and a self-shutoff delay processing routine, respectively, according to Embodiment 2; however, because these are the same as those in Embodiment 1, the explanation therefor will be omitted.

Figure 13:
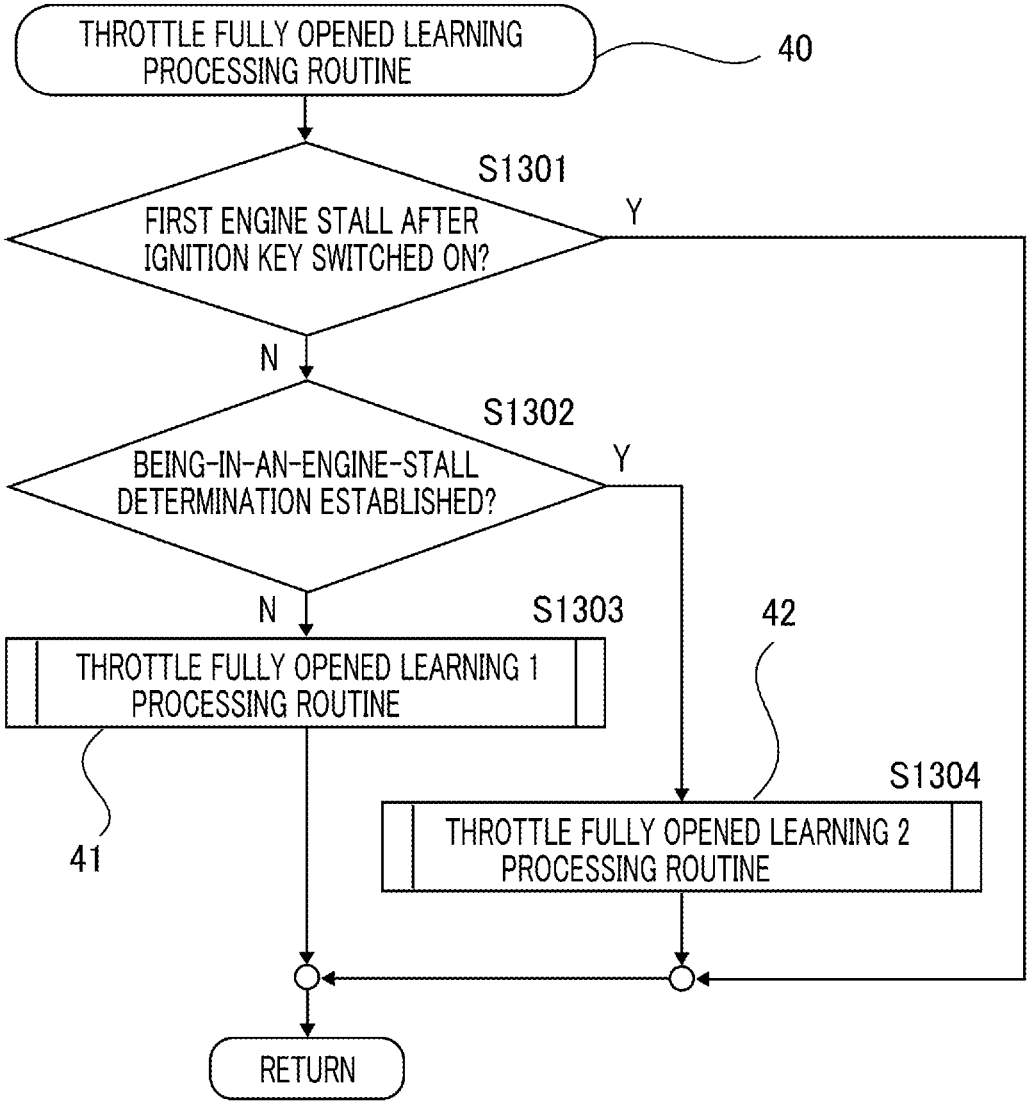
FIG. 13 is a flowchart representing the flow of a throttle fully opened learning processing routine performed in an embodiment of the present invention.

FIG. 13 is the flow of the throttle fully opened learning processing routine 40.

At first, in the step S1301, ECU 2 determines whether or not the present engine stall is the first one after the ignition key switch has turned on; in the case where the present engine stall is the first one after the ignition key switch has turned on ("Y" in S1301), the routine is ended; in the case where the present engine stall is not the first one after the ignition key switch has turned on ("N" in S1301), the step S1301 is followed by the step S1302.

Next, in the step S1302, ECU 2 determines whether or not a being-in-an-engine-stall determination has been established.

In the case where the being-in-an-engine-stall determination has not been established ("N" in S1302), the step S1302 is followed by the step S1303, and ECU 2 calls the throttle fully opened learning 1 processing routine 41, described later, and then ends the routine. In contrast, in the case where the being-in-an-engine-stall determination has been established ("Y" in S1302), the step S1302 is followed by the step S1304, and ECU 2 calls the throttle fully opened learning 2 processing routine 42, described later, and then ends the routine.

Figure 14:
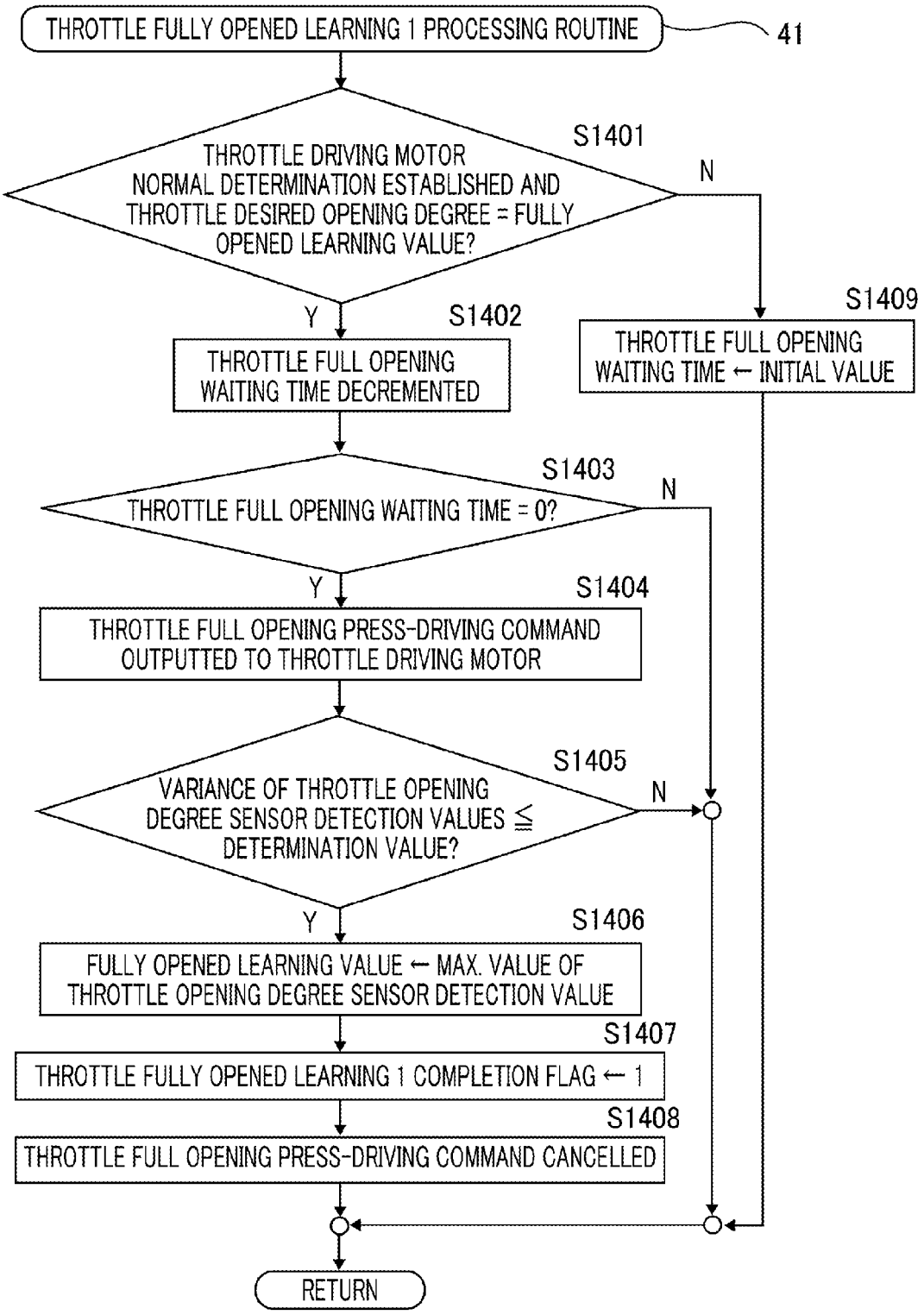
FIG. 14 is a flowchart representing the flow of the processing routine in a throttle fully opened learning 1 performed in an embodiment of the present invention.

FIG. 14 is the flow of the throttle fully opened learning 1 processing routine 41.

At first, in the step S1401, ECU 2 determines whether or not a predetermined determination on the normality of the throttle driving motor has been established and the throttle desired opening degree has coincided with the fully opened learning value.

In the case where the determination on the normality of the throttle driving motor has been established and the throttle desired opening degree has coincided with the fully opened learning value ("Y" in S1401), the step S1401 is followed by the step S1402; however, in the case where the determination on the normality of the throttle driving motor has not been established or the throttle desired opening degree has not coincided with the fully opened learning value ("N" in S1401), the step S1401 is followed by the step S1409.

In the step S1409, ECU 2 sets the throttle full closing waiting time to an initial value (e.g., 0.2 [sec]) and then ends the routine.

On the other hand, ECU 2 decrements the throttle full opening waiting time in the step S1402.

Next, in the step S1403, ECU 2 determines whether or not the throttle full opening waiting time has reached "0"; in the case where the throttle full opening waiting time has reached "0" ("Y" in S1403), the step S1403 is followed by the step S1404, and in the case where the throttle full opening waiting time has not reached "0" ("N" in S1403), the routine is ended.

In the step S1404, ECU 2 outputs a throttle full opening press-driving command to the throttle driving motor 3.

As a result, the throttle valve 4 is pressed to the mechanical fully opened position; however, because the throttle has already been stabilized at the fully opened position or approximately at the fully opened position before the step S1404 is implemented, the implementation of the step S1404 provides no effect to the engine control.

Next, in the step S1405, ECU 2 refers to the variance of throttle opening degree sensor detection values calculated in the immediately previous constant-time interruption processing routine 10; in the case where the variance is the same as or smaller than a determination value (e.g., 0.005) ("Y" in S1405), ECU 2 determines that the sampled throttle opening degree sensor detection values have sufficiently converged, and the step S1405 is followed by the step S1406; however, in the case where the variance exceeds the determination value (e.g., 0.005) ("N" in S1405), ECU 2 determines that the sampled throttle opening degree sensor detection values have not sufficiently converged, and then ends the routine.

Next, in the step S1406, ECU 2 sets the fully opened learning value to the throttle opening degree sensor detection maximum value calculated in the immediately previous constant-time interruption processing routine 10.

Next, in the step S1407, ECU 2 sets the throttle fully opened learning 1 completion flag to "1 (completed)".

At last, in the step S1408, ECU 2 cancels the throttle full opening press-driving command that has been issued to the throttle driving motor 3, and then ends the routine.

Figure 15:
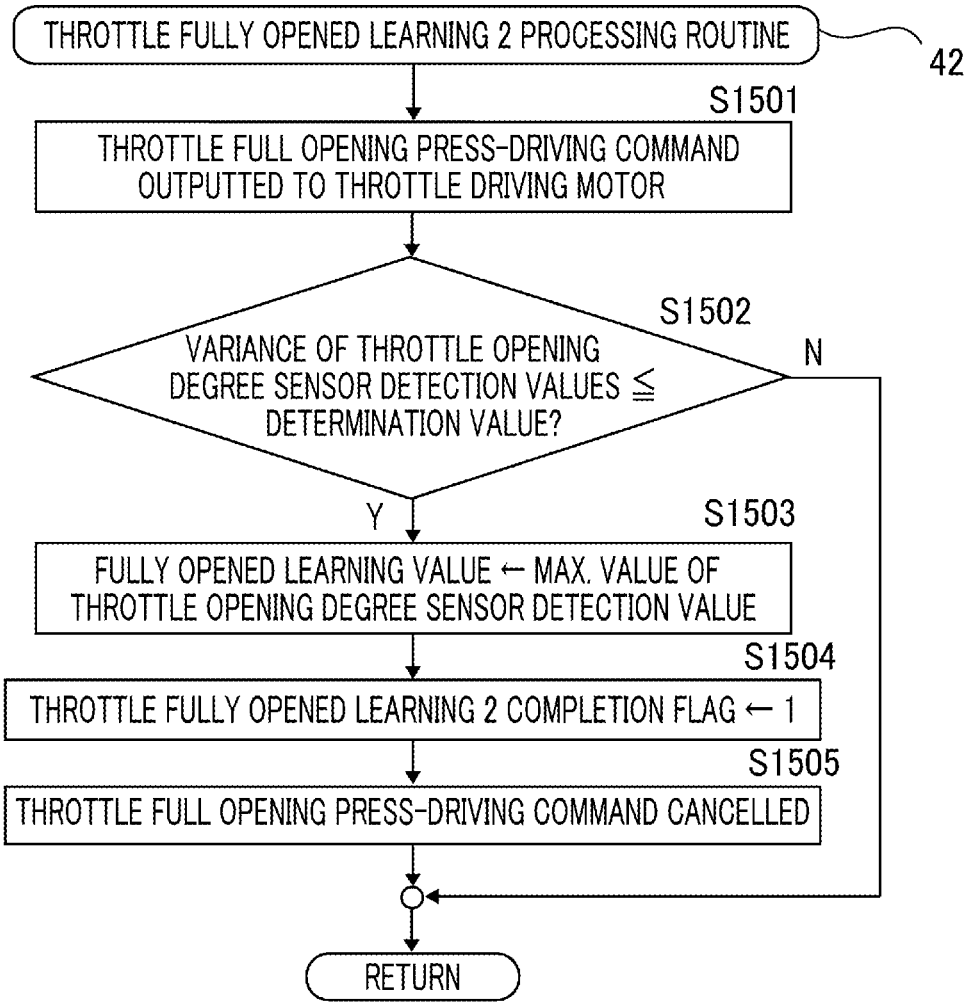
FIG. 15 is a flowchart representing the flow of the processing routine in a throttle fully opened learning 2 performed in an embodiment of the present invention.

FIG. 15 is the flow of the throttle fully opened learning 2 processing routine 42.

At first, in the step S1501, ECU 2 outputs the throttle full opening press-driving command to the throttle driving motor 3.

As a result, the throttle valve 4 is pressed to the mechanical fully opened position; however, because the engine 1 has already been stabilized to the engine stall condition before the step S1501 is implemented, the implementation of the step S1501 provides no effect to the control.

Next, in the step S1502, ECU 2 refers to the variance of throttle opening degree sensor detection values calculated in the immediately previous constant-time interruption processing routine 10; in the case where the variance is the same as or smaller than a determination value (e.g., 0.005) ("Y" in S1502), ECU 2 determines that the sampled throttle opening degree sensor detection values have sufficiently converged, and the step S1502 is followed by the step S1503; however, in the case where the variance exceeds the determination value (e.g., 0.005) ("N" in S1502), ECU 2 determines that the sampled throttle opening degree sensor detection values have not sufficiently converged, and then ends the routine.

Next, in the step S1506, ECU 2 sets the fully closed learning value to the throttle opening degree sensor detection maximum value calculated in the immediately previous constant-time interruption processing routine 10. In this step, the fully opened learning value is updated.

Next, in the step S1504, ECU 2 sets the throttle fully opened learning 2 completion flag to "1 (completed)".

At last, in the step S1505, ECU 2 cancels the throttle full opening press-driving command that has been issued to the throttle driving motor 3, and then ends the routine.

Figure 17:
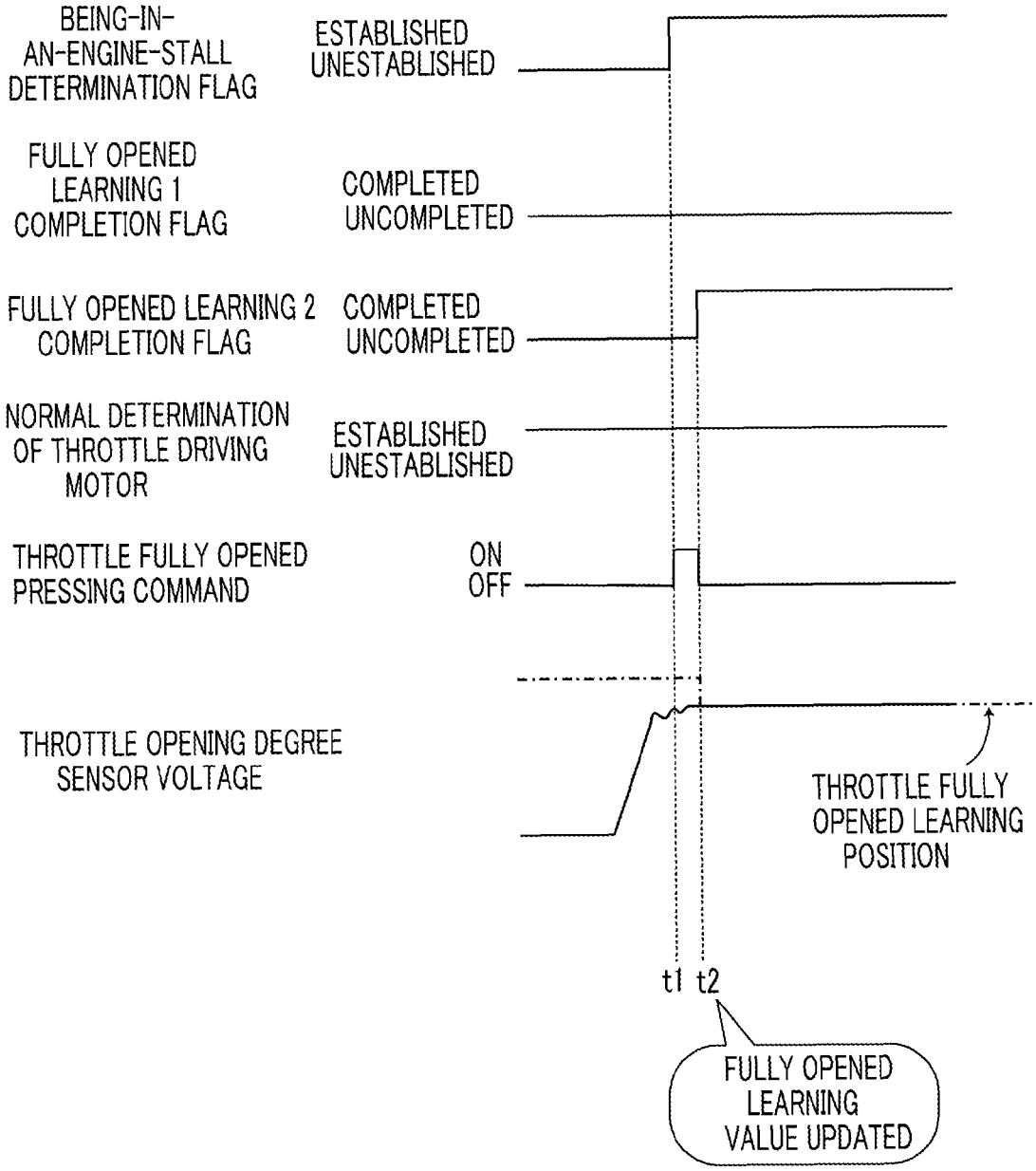
FIG. 17 is a timing chart representing the operation of fully opened learning 2 according to the present invention.
Figure 18:
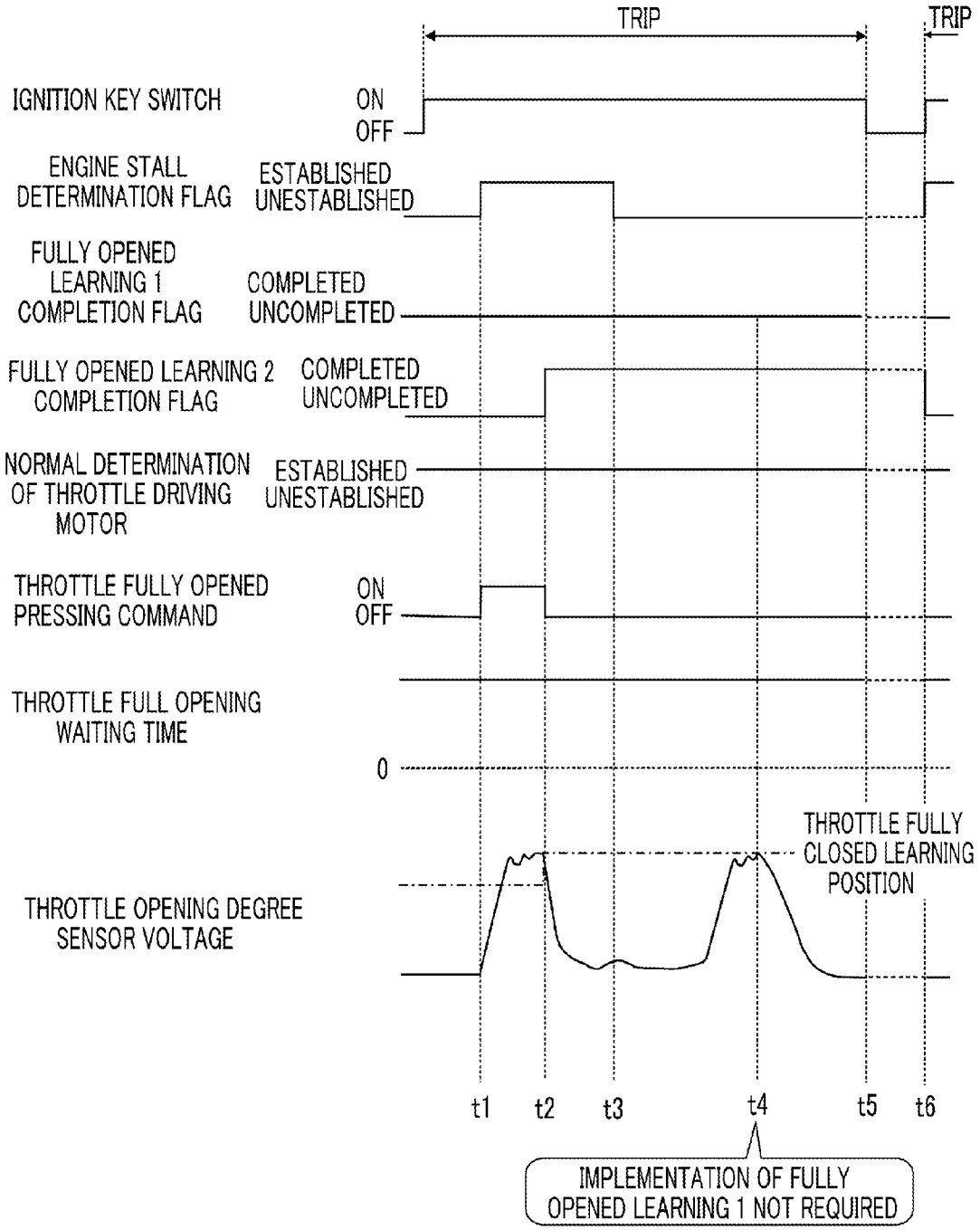
FIG. 18 is a timing chart representing the operation of fully opened learning within one trip according to the present invention.

An example of operation of Embodiment 2 described above will be represented in FIGS. 16 through 18. Each of FIGS. 16 through 18 represents the trip at a time after a self-shutoff delay abnormality has been detected.

Figure 16:
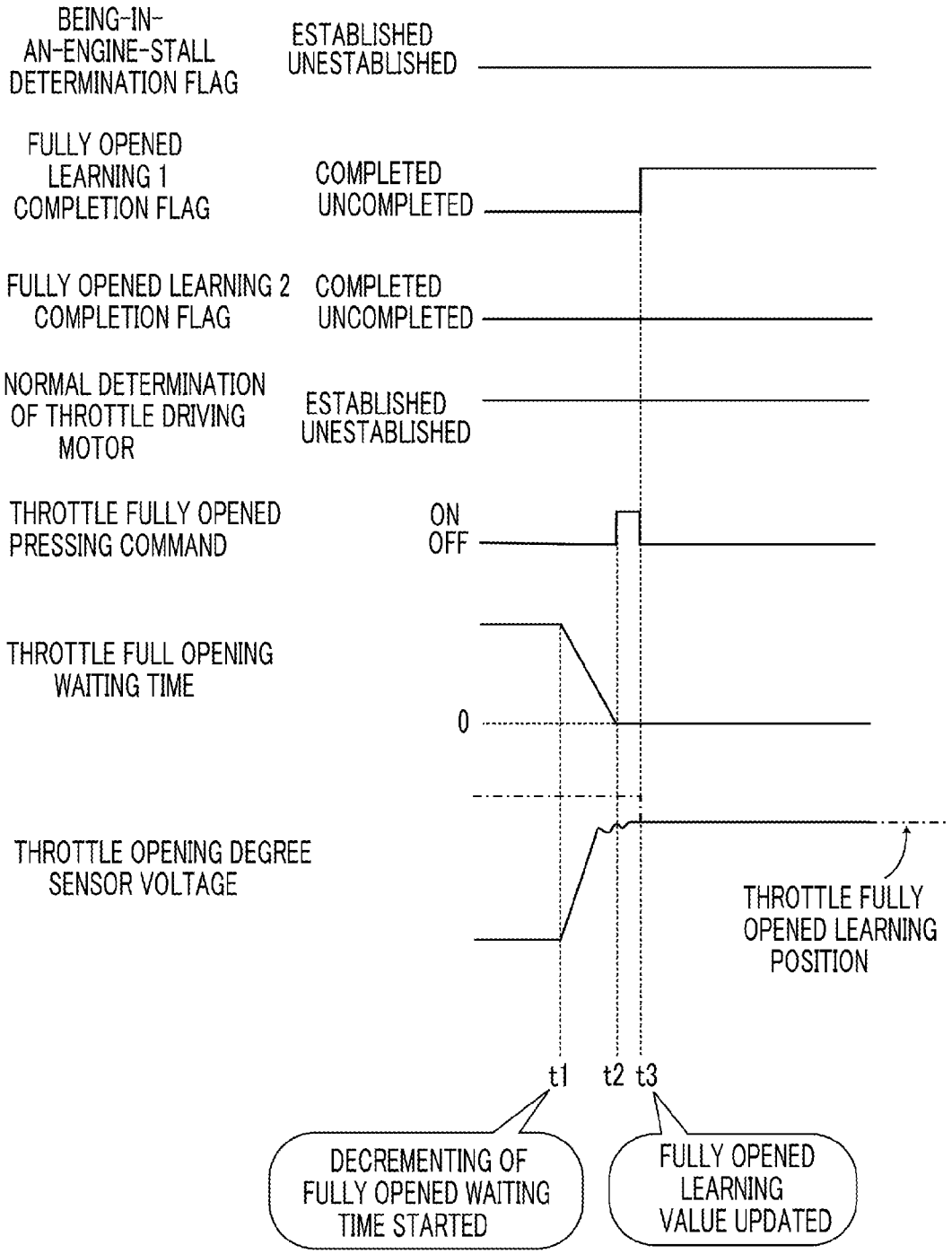
FIG. 16 is a timing chart representing the operation of fully opened learning 1 according to the present invention.

FIG. 16 represents an operation timing chart of the fully opened learning 1 based on the throttle fully opened learning 1 processing routine 41. In FIG. 16, it is assumed that the dashed line after a time point t3 is a throttle fully opened learning position that is newly learned by the ECU 2.

In the case where in the main processing routine 20, the fully closed learning 1 or the fully closed learning 2 has been completed ("N" in S507) and neither the fully opened learning 1 nor the fully opened learning 2 has been completed ("Y" in S509), the throttle fully opened learning processing routine 40 in the step S510 is called. At a time point t1 in FIG. 16, the being-in-an-engine-stall determination is not established ("N" in S1302); therefore, the throttle fully opened learning 1 processing routine 41 in the step S1303 is called.

In the case where in the throttle fully opened learning 1 processing routine 41, the throttle desired opening degree coincides with the fully opened learning value and the throttle driving motor is normal ("Y" in S1401), ECU 2 starts to decrement the throttle full opening waiting time (S1402 is implemented). After that, when at a time point t2 in FIG. 16, the throttle full opening waiting time reaches "0" ("Y" in S1403), ECU 2 outputs the throttle full opening press-driving command to the throttle driving motor 3 (S1404 is implemented). Then, when at the time point t3, the throttle opening degree detection values converge ("Y" in S1405), ECU 2 updates the fully opened learning value (S1406 is implemented) and, at the same time, sets the fully opened learning 1 completion flag (S1407 is implemented); then, the throttle full opening press-driving command is cancelled (S1408 is implemented).

Next, FIG. 17 represents a timing chart of the fully opened learning 2 based on the throttle fully opened learning 2 processing routine 42. In FIG. 17, it is assumed that the dashed line after a time point t2 is a throttle fully opened learning position that is newly learned by the ECU 2.

In the case where in the main processing routine 20, the fully closed learning 1 or the fully closed learning 2 has been completed ("N" in S507) and neither the fully opened learning 1 nor the fully opened learning 2 has been completed ("Y" in S509), the throttle fully opened learning processing routine 40 in the step S510 is called. At a time point t1 in FIG. 17, the being-in-an-engine-stall determination is established ("Y" in S1302); therefore, the throttle fully opened learning 2 processing routine 42 in the step S1304 is called.

In the throttle fully opened learning 2 processing routine 42, ECU 2 outputs the throttle full opening press-driving command to the throttle driving motor 3 (S1501 is implemented). Then, when at the time point t2 in FIG. 17, the throttle opening degree detection values converge ("Y" in S1502), ECU 2 updates the fully opened learning value (S1503 is implemented) and, at the same time, sets the fully opened learning 2 completion flag (S1504 is implemented); then, the throttle full opening press-driving command is cancelled (S15905 is implemented).

Next, FIG. 18 represents an example of whether or not the fully opened learning 1 and the fully opened learning 2 are implemented in one trip. FIG. 18 represents a situation in which the fully opened learning 2 is firstly started.

In the case where in the main processing routine 20, the fully closed learning 1 or the fully closed learning 2 has been completed ("N" in S507) and neither the fully opened learning 1 nor the fully opened learning 2 has been completed ("Y" in S509), the throttle fully opened learning processing routine 40 in the step S510 is called. At a time point t1 in FIG. 18, the being-in-an-engine-stall determination is established ("Y" in S1302); therefore, the throttle fully opened learning 2 processing routine 42 in the step S1304 is called.

At the time point t1 in FIG. 18, ECU 2 outputs the throttle full closing press-driving command to the throttle driving motor 3 (S1501 is implemented). Then, when at a time point t2, the throttle opening degree detection values converge ("Y" in S1502), ECU 2 updates the fully opened learning value (S1503 is implemented) and, at the same time, sets the fully opened learning 2 completion flag (S1504 is implemented); then, the throttle full opening press-driving command is cancelled (S1505 is implemented), so that the throttle fully opened learning 2 processing routine 42 is ended.

After that, at a time point t3 in FIG. 18, the throttle is opened again; then at a time point t4, the engine stall condition is established due to an idling stop. However, because at the time point t4, the throttle fully opened learning 2 completion flag has already been set to "1", the result of the step S509 of the main processing routine 20 becomes "N"; thus, the fully closed learning 1 included in the step S510 of the main processing routine 20 is not implemented. As a result, ECU 2 can suppress superfluous fully opened learning.

After that, when at a time point t5 in FIG. 18, the ignition key switch 7 is turned off, power supply to ECU 2 is cut off due to a self-shutoff delay abnormality and hence the value of the fully opened learning 2 becomes indeterminate (indicated by a dotted line); however, the value of the fully closed learning 1 is reset to "0" (uncompleted) at a time point t6, which is the foremost point of the next trip (in S504 of the main processing routine 20).

Embodiment 3

In Embodiment 3, improvement of the opportunity of throttle fully opened learning will be explained.

FIGS. 2 through 7 and FIGS. 9, 13, and 15 are block diagrams illustrating the configurations of an electronically-controlled throttle system and an engine, and flowcharts representing a constant-time interruption processing routine, a main processing routine, a self-shutoff delay processing routine, a throttle fully closed learning 2 processing routine, and a throttle fully opened learning 2 processing routine, respectively, according to Embodiment 3.

Figure 19:
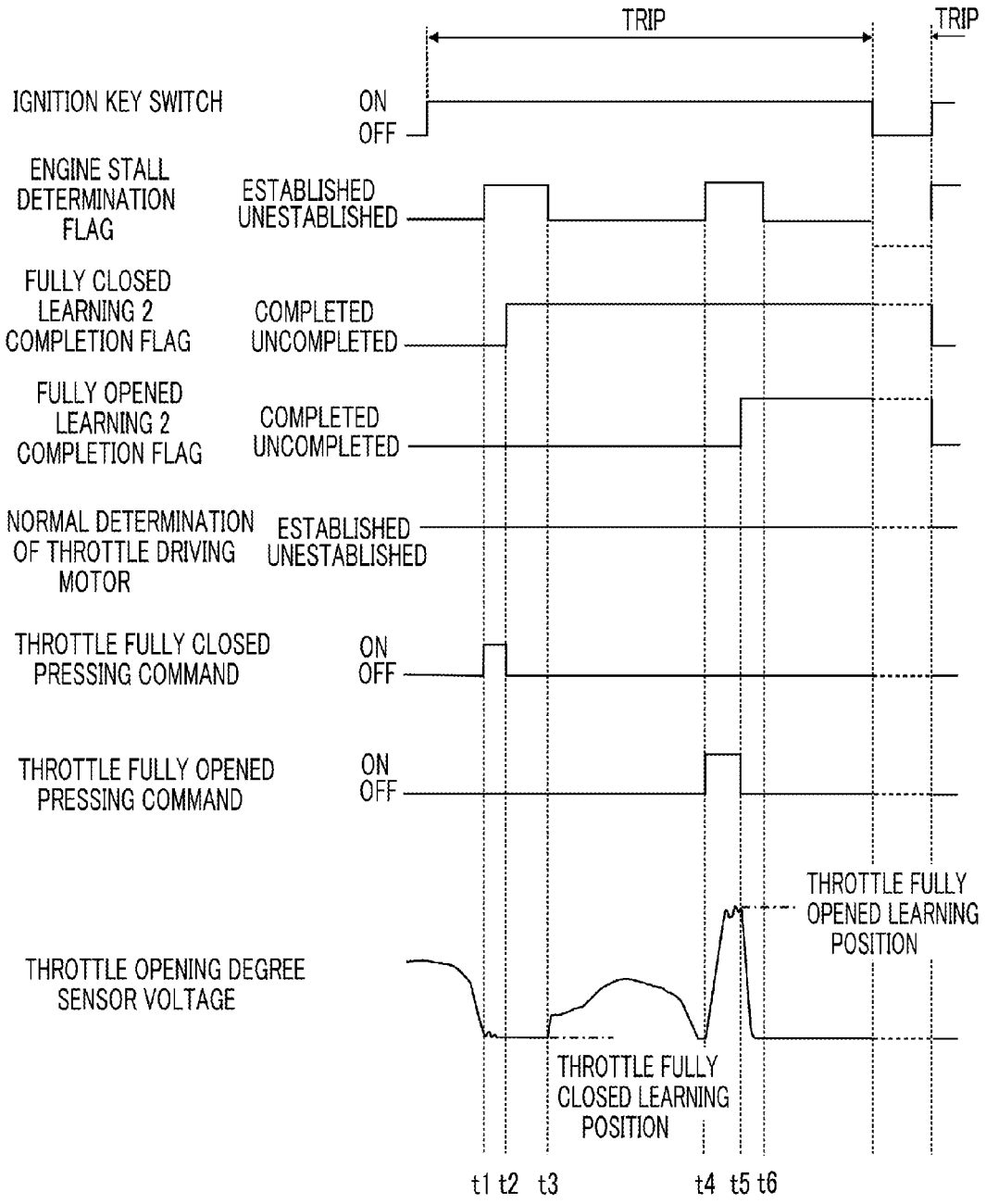
FIG. 19 is a timing chart representing the relationship between fully closed learning and fully opened learning according to the present invention.

FIG. 19 represents an operation timing chart of the fully closed learning 2 and the fully opened learning 2 based on Embodiment 3. FIG. 19 represents the trip at a time after a self-shutoff delay abnormality has been detected.

In the case where in the main processing routine 20, neither the fully closed learning 1 nor the fully closed learning 2 has been completed ("Y" in S507), the throttle fully closed learning processing routine 30 in the step S508 is always called. At a time point t1 in FIG. 19, the being-in-an-engine-stall determination is established ("Y" in S602); therefore, the throttle fully closed learning 2 processing routine 32 in the step S604 is called. The operation of the throttle fully closed learning 2 processing routine 32 is the same as that described above with respect to FIG. 9; therefore, the explanation therefor will be omitted. When at a time point t2, the fully closed learning 2 is completed, an engine stall due to an idling stop is cancelled at a time point t3.

Next, at a time point t4 in FIG. 19 at which the engine stall occurs due to an idling stop, the throttle fully opened learning 2 processing routine 42 is called. The operation of the throttle fully opened learning 2 processing routine 42 is the same as that described above with respect to FIG. 15; therefore, the explanation therefor will be omitted. After that, when at a time point t5, the fully opened learning 2 is completed, the engine stall due to an idling stop is cancelled at a time point t6. In Embodiment 3, when a plurality of relatively long engine stalls occur due to frequent idling stops, both the fully closed learning and the fully opened learning are completed in the corresponding trip; therefore, neither the fully closed learning nor the fully opened learning is required and hence the reliability of the throttle learning is raised.

The respective predetermined values and the respective determination values utilized in the foregoing embodiments are examples; it is required to appropriately adjust these values in accordance with the characteristic of each throttle system. In addition, in the respective calculations of the average of throttle opening degree sensor detection values and the variance of throttle opening degree sensor detection values in the constant-time interruption processing routine 10, five immediately previous throttle opening degree sensor detection values have been utilized; however, this is also an example, and it is required to appropriately adjust the number of samples in accordance with the characteristic of each throttle system.

Various modifications and alterations of this invention will be apparent to those skilled in the art without departing from the scope and spirit of this invention, and it should be understood that this is not limited to the illustrative embodiments set forth herein.

What is claimed is:

1. A throttle learning control apparatus having an electronic control unit (ECU) comprising at least one processor configured to receive a signal from a throttle opening degree sensor for detecting an opening degree position of a throttle mounted in an automobile, perform, in a normal case, fully closed learning of the throttle implemented during a self-shutoff delay period, set, as a trip, a cycle from a starting point at which an ignition key switch of the automobile is turned on to an ending point at which the ignition key switch is turned off, and perform a first throttle fully closed learning in which fully closed learning of the throttle is implemented when, in the trip after a self-shutoff delay abnormality has been detected, a predetermined condition is established while the engine is operated, perform a second throttle fully closed learning in which fully closed learning of the throttle is implemented when, in the trip after a self-shutoff delay abnormality has been detected, the engine is stopped, and prevent, when the first throttle fully closed learning or the second throttle fully closed learning is completed, both of the first throttle fully closed learning and the second throttle fully closed learning from being performed during a remainder of the trip, wherein the self-shutoff delay period is a period during which power is supplied to the ECU to perform the fully closed learning after the ending point at which the ignition key is turned off, and wherein the self-shutoff delay abnormality is detected when the fully closed learning of the throttle implemented during the self-shutoff delay period is not successfully performed.

2. A throttle learning control apparatus having an electronic control unit (ECU) comprising at least one processor configured to receive a signal from a throttle opening degree sensor for detecting an opening degree position of a throttle mounted in an automobile, perform, in a normal case, fully opened learning of the throttle implemented during a self-shutoff delay period, set, as a trip, a cycle from a starting point at which an ignition key switch of the automobile is turned on to an ending point at which the ignition key switch is turned off, and perform a first throttle fully opened learning in which fully opened learning of the throttle is implemented when, in the trip after a self-shutoff delay abnormality has been detected, a predetermined condition is established while the engine is operated, perform a second throttle fully opened learning in which fully opened learning of the throttle is implemented when, in the trip after a self-shutoff delay abnormality has been detected, the engine is stopped, and prevent, when the first fully opened learning or the second throttle fully opened learning is completed, both of the first throttle fully opened learning and the second throttle fully opened learning from being performed during a remainder of the trip, wherein the self-shutoff delay period is a period during which power is supplied to the ECU to perform the fully opened learning after the ending point at which the ignition key is turned off, and wherein the self-shutoff delay abnormality is detected when the fully opened learning of the throttle implemented during the self-shutoff delay period is not successfully performed.

3. A throttle learning control apparatus having an electronic control unit (ECU) comprising at least one processor configured to receive a signal from a throttle opening degree sensor for detecting an opening degree position of a throttle mounted in an automobile, perform, in a normal case, fully closed learning of the throttle implemented during a self-shutoff delay period, set, as a trip, a cycle from a starting point at which an ignition key switch of the automobile is turned on to an ending point at which the ignition key switch is turned off, and perform a first throttle fully closed learning in which fully closed learning of the throttle is implemented when, in the trip after a self-shutoff delay abnormality has been detected, a predetermined condition is established while the engine is operated, perform a second throttle fully closed performed in which fully closed learning of the throttle is implemented when, in the trip after a self-shutoff delay abnormality has been detected, the engine is stopped, prevent, when the first throttle fully closed learning or the second throttle fully closed learning is completed, both of the first throttle fully closed learning and the second throttle fully closed learning from being performed during a remainder of the trip, perform a first throttle fully opened learning in which fully opened learning of the throttle is implemented when, in the trip after a self-shutoff delay abnormality has been detected, a predetermined condition is established while the engine is operated, perform a second throttle fully opened learning in which fully opened learning of the throttle is implemented when, in the trip after a self-shutoff delay abnormality has been detected, the engine is stopped, and prevent, when the first fully opened learning or the second throttle fully opened learning is completed, both of the first throttle fully opened learning and the second throttle fully opened learning from being performed during a remainder of the trip, wherein the at least one processor is further configured to perform the second throttle fully opened learning after the second throttle fully closed learning has been completed, wherein the self-shutoff delay period is a period during which power is supplied to the ECU to perform the fully closed learning after the ending point at which the ignition key is turned off, and wherein the self-shutoff delay abnormality is detected when the fully closed learning of the throttle implemented during the self-shutoff delay period is not successfully performed.

* * * * *